US008403183B2

(12) United States Patent
Fahy et al.

(10) Patent No.: US 8,403,183 B2
(45) Date of Patent: Mar. 26, 2013

(54) DEVICE FOR ATTACHING A DIP TUBE TO A FLUID CONTAINER

(75) Inventors: Cathal L. Fahy, Racine, WI (US); Timothy R. Bartlett, Racine, WI (US); Kenneth W. Michaels, Spring Grove, IL (US); René Maurice Béland, Waterford, WI (US); Peter M. Neumann, Racine, WI (US); David H. Leifheit, Racine, WI (US); Thomas Jaworski, Kenosha, WI (US)

(73) Assignee: S. C. Johnson & Son, Inc., Racine, WI (US)

( * ) Notice: Subject to any disclaimer, the term of this patent is extended or adjusted under 35 U.S.C. 154(b) by 1157 days.

(21) Appl. No.: 11/933,582

(22) Filed: Nov. 1, 2007

(65) Prior Publication Data

US 2008/0105713 A1 May 8, 2008

Related U.S. Application Data

(63) Continuation-in-part of application No. 11/556,274, filed on Nov. 3, 2006, now Pat. No. 7,938,299.

(51) Int. Cl.
*B67D 7/58* (2010.01)

(52) U.S. Cl. ..... 222/382; 222/383.1; 239/333

(58) Field of Classification Search ..... 222/147, 222/321.1, 321.7, 322, 372, 382, 383.1, 464.1; 239/333

See application file for complete search history.

(56) References Cited

U.S. PATENT DOCUMENTS

| | | | | |
|---|---|---|---|---|
| 1,329,524 | A | | 2/1920 | Hill |
| 2,091,737 | A | | 8/1937 | Longway |
| 2,496,258 | A | | 2/1950 | Alexander |
| 2,781,576 | A | | 2/1957 | Jennings |
| 3,655,096 | A | | 4/1972 | Easter |
| 3,672,028 | A | | 6/1972 | Boling |
| 3,674,179 | A | | 7/1972 | Galloway |
| 3,708,854 | A | | 1/1973 | Nalbach |
| 3,797,749 | A | * | 3/1974 | Tada ..... 239/321 |
| 3,880,207 | A | | 4/1975 | Giuffredi |
| 4,022,258 | A | | 5/1977 | Steidley |
| 4,077,442 | A | * | 3/1978 | Olofsson ..... 141/20 |
| 4,154,369 | A | * | 5/1979 | Morane ..... 222/147 |
| 4,162,601 | A | | 7/1979 | Allen |
| 4,220,285 | A | | 9/1980 | Gualdi |
| 4,591,192 | A | | 5/1986 | Van Exel et al. |
| 4,730,751 | A | | 3/1988 | Mackles et al. |
| 4,770,323 | A | | 9/1988 | Debard |
| 4,915,351 | A | | 4/1990 | Hoffman |
| 5,244,126 | A | * | 9/1993 | Geier ..... 222/383.1 |

(Continued)

FOREIGN PATENT DOCUMENTS

WO WO 2004/043611 5/2004

*Primary Examiner* — Kevin P Shaver
*Assistant Examiner* — Daniel R Shearer

(57) ABSTRACT

A device for that places a fluid container in fluid communication with a sprayer is disclosed. The device includes a container adapter that allows a dip tube to be attached to the fluid container rather than the sprayer. When the sprayer is removed from the fluid container, the dip tube stays in the fluid container. Refill fluid containers may come with the container adapter and dip tube installed. When the sprayer is attached to the fluid container, the adapter seals against the sprayer allowing fluid to be pumped from the fluid container by the sprayer. A sprayer connector with geometry that matches an inner or outer shape of the adapter is attached to and/or built into the sprayer. The sprayer connector is constructed to allow easy alignment of the sprayer to the fluid container. The sprayer connector and the container adapter also provide a unique attachment geometry to insure only containers with formulae compatible to the sprayer are pumped through the sprayer.

12 Claims, 11 Drawing Sheets

U.S. PATENT DOCUMENTS 5,246,146 A * 9/1993 Bartimes et al. ..... 222/382
5,716,007 A 2/1998 Nottingham et al.
5,791,366 A 8/1998 Lo
5,803,510 A 9/1998 Dorsey, III
5,810,209 A 9/1998 Foster
5,839,620 A 11/1998 Battegazzore
5,857,591 A * 1/1999 Bachand ..... 222/1
5,873,496 A 2/1999 Montaner et al.
5,878,915 A 3/1999 Gordon et al.
6,050,459 A 4/2000 Johnson et al.
6,138,873 A 10/2000 Gramola
6,155,462 A 12/2000 Brecheisen et al.
6,269,976 B1 8/2001 DeJonge
6,367,665 B1 4/2002 Barriac et al.
6,398,080 B1 6/2002 De LaForcade et al.
6,409,052 B1 6/2002 Barriac et al.
6,419,128 B1 7/2002 Barriac et al.
6,543,564 B1 4/2003 Kamen et al.
6,543,654 B1 4/2003 Uhl et al.
6,554,319 B2 4/2003 Barriac et al.
6,568,562 B1 5/2003 Klima, Jr. et al.
6,659,311 B2 * 12/2003 Prueter ..... 222/136
6,779,693 B2 8/2004 Sweeton et al.
6,935,542 B2 8/2005 Harrity et al.
2003/0213816 A1 11/2003 Harrity et al.
2004/0134562 A1 7/2004 Engel
2004/0262420 A1 12/2004 Hansen et al.
2005/0189380 A1 9/2005 Sweeton et al.
2006/0174968 A1 8/2006 De Luna

* cited by examiner

DEVICE FOR ATTACHING A DIP TUBE TO A FLUID CONTAINER

CROSS-REFERENCES TO RELATED APPLICATIONS

This application is a continuation-in-part of U.S. patent application Ser. No. 11/556,274 filed Nov. 3, 2006 now U.S. Pat No. 7,938,299.

STATEMENT REGARDING FEDERALLY SPONSORED RESEARCH

Not Applicable.

BACKGROUND OF THE INVENTION

1. Field of the Invention

This invention relates to a device including a container adapter that allows a dip tube to be attached to a fluid container rather than the fluid sprayer. When the sprayer is removed from the fluid container, the dip tube stays in the fluid container. When the sprayer is attached to the fluid container, the container adapter seals against a sprayer connector allowing fluid to be pumped from the fluid container by the sprayer.

2. Description of the Related Art

A variety of devices are known for delivering liquid from a container. Some devices rely on a manual trigger pump sprayer. See, for example, U.S. Pat. No. 4,747,523. Still other devices use a motorized pumping system such as that shown in U.S. Patent Application Publication No. 2005/0133626. The disclosure of this patent and publication, and all other patents and publications referred to herein, are incorporated by reference as if fully set forth herein.

Often these devices use a dip tube (also referred to as a down tube) that extends from the sprayer unit down into the container holding the liquid to be dispensed. The upper end of the dip tube is typically connected to a sprayer inlet port, and the lower end of the dip tube is positioned near the bottom of the interior space of the container. In such devices, the pump will suck liquid from the container through the dip tube and then pump the liquid out of a sprayer nozzle.

It can be important to prevent the use of a liquid not intended for use with a particular sprayer. For example, one may not want to mistakenly use an outdoor insecticide in a sprayer intended to dispense a cleaner for an indoor food contact surface. Therefore, under these circumstances, it is preferred that the sprayer and/or refill container include keying structures that prevent use of a refill containing an inappropriate liquid with the sprayer. These keying structures ensure that only refill containers containing a liquid appropriate for a particular purpose are used with the sprayer. These keying structures may also provide for easy alignment of the sprayer and the fluid container, both during high speed automated assembly of the sprayer to a container at a manufacturing site and when a consumer assembles a refill container to a sprayer.

Thus, there is a need for a device that places a fluid container in fluid communication with a sprayer and that provides a keying structure such that only refill containers having a liquid appropriate for a particular purpose are used with the sprayer.

SUMMARY OF THE INVENTION

The foregoing needs can be met with a device according to the invention which includes a container adapter that allows the dip tube to be attached to the fluid container rather than the sprayer. When the sprayer is removed from the fluid container, the dip tube stays in the fluid container. Refill fluid containers may come with the adapter and dip tube installed. When the sprayer is attached to the fluid container, the adapter seals against a sprayer connector allowing fluid to be pumped from the fluid container by the sprayer.

In one form, a feature with geometry that matches the inner or outer shape of the container adapter is attached to and/or built into the sprayer. The feature is constructed to allow easy alignment of the sprayer to the fluid container. The container adapter also provides a unique attachment geometry to insure only containers with formulae compatible to the sprayer are pumped through the sprayer. Thus, the invention may include two parts, the first is being the container adapter which is fit into or onto the neck of a fluid container. The container adapter includes structure for attaching the dip tube to the adapter. The second part of the invention may be a mating sprayer connector which is attached to the sprayer inlet port such as by a friction fit. Alternatively, the sprayer connector can be integral with the sprayer to incorporate the necessary geometry. When the sprayer is placed onto the fluid container, the mating sprayer connector is pressed into or over the container adapter thereby sealing the mating sprayer connector against a surface of the container adapter.

In one aspect, the invention provides a device for placing an inlet port of a sprayer in fluid communication with an interior space of a container. The device includes a container adapter with (i) an outer wall that terminates at an open end of the adapter wherein the outer wall is dimensioned to engage an inner surface of the neck of the container, (ii) a hollow inlet port that terminates at an upstream open end and that terminates at a downstream open end, and (iii) a hollow inner wall connecting the outer wall and the upstream open end of the inlet port wherein at least part of the inner wall slopes inward from the outer wall toward the upstream open end of the inlet port. Together the inner wall and the inlet port of the adapter may be funnel shaped. The device also includes a sprayer connector having a flow conduit suitable for being placed in fluid communication with the inlet port of the sprayer and the adapter wherein the sprayer connector is dimensioned to matingly engage the inner wall of the adapter to create a flow path from the container to the sprayer. The sprayer connector may be integral with the inlet port of the sprayer.

The device may further include a dip tube, and the downstream open end of the inlet port of the adapter may be dimensioned to sealingly engage the dip tube. The inner wall of the adapter may include venting holes for transferring air into the container. The outer surface of the sprayer connector or inner surface of the adapter may include at least one sealing rib for an air-tight fit. Optionally, the open end of the adapter includes an outwardly projecting lateral flange for engaging a top surface of the neck of the container or a gasket on the top surface of the neck of the container. The adapter may further include a skirt that extends longitudinally from the lateral flange, and an inner surface of the skirt may include a sealing protrusion for engaging an outer surface of the neck of the container. The outer surface of the skirt may also include threads for engaging inner threads on a sprayer attachment cap. The sprayer connector may include an outwardly extending exit port in fluid communication with the flow conduit, and the exit port may be dimensioned to sealingly engage the inlet port of the sprayer.

In another aspect, the invention provides a fluid container for attaching to a sprayer having an inlet port. The container may be sold as a separate refill container with a dip tube and without the sprayer. The container includes a bottom wall, side wall structure, and a neck having an opening. The bottom wall, the side wall structure, and the neck define an interior space of the container for holding liquid. The container also includes a container adapter having (i) an outer wall that terminates at an open end of the adapter wherein the outer wall is dimensioned to engage an inner surface of the neck of the container, (ii) a hollow inlet port that terminates at an upstream open end and that terminates at a downstream open end, and (iii) a hollow inner wall connecting the outer wall and the upstream open end of the inlet port wherein at least part of the inner wall slopes inward from the outer wall toward the upstream open end of the inlet port.

The refill container may have other features. The inlet port of the adapter may further comprise a dip tube that is separable from the inlet port of the adapter, and the downstream open end of the inlet port of the adapter may be dimensioned to sealingly engage the dip tube. The inner wall of the adapter may include venting holes for transferring air into the container. The open end of the adapter may include an outwardly projecting lateral flange for engaging a top surface of the neck of the container or a gasket on the top surface of the neck of the container. The adapter may further include a skirt that extends longitudinally from the lateral flange, and an inner surface of the skirt may include a sealing protrusion for engaging a groove in an outer surface of the neck of the container. The outer surface of the skirt may also include threads for engaging threads on a sprayer attachment cap.

In still another aspect, the invention provides a sprayer including a nozzle, an inlet port, and pumping means for delivering fluid from the inlet port to the nozzle. The sprayer further includes a sprayer connector having a fluid exit port, a fluid entry port, a tubular flow conduit connecting the fluid exit port and the fluid entry port such that the fluid exit port is in fluid communication with the fluid entry port, and a tubular outer wall defining an interior space of the sprayer connector. At least a portion of the tubular flow conduit is located within the interior space of the sprayer connector, and the sprayer connector is connected to the inlet port such that the fluid exit port is in fluid communication with the inlet port. The portion of the tubular flow conduit can be offset from a central axis of the outer wall of the sprayer connector, and an outer surface of the sprayer connector can include at least one sealing rib. In one form, the tubular outer wall of the sprayer connector terminates in a transverse bottom wall, and the fluid entry port is located in the bottom wall. The outer wall can include a cutaway section near the fluid exit port.

In yet another aspect, the invention provides a device for placing an inlet port of a sprayer in fluid communication with an interior space of a container. The device has a container adapter including (i) a hollow inlet port that terminates at an downstream open end and that terminates at an upstream end, and (ii) an outer wall that terminates at an open end of the adapter opposite the upstream end of the inlet port of the adapter wherein the outer wall is connected to the inlet port and an inner surface of the outer wall is dimensioned to engage an outer surface of the neck of the container. The device also includes a sprayer connector having a flow conduit suitable for being placed in fluid communication with the inlet port of the sprayer wherein an inner surface of the sprayer connector is dimensioned to matingly engage an outer surface of the outer wall of the adapter to create a flow path from the container to the sprayer. The inlet port of the adapter may further comprise a dip tube that is separable from the inlet port of the adapter, and the downstream open end of the inlet port of the adapter may be dimensioned to sealingly engage the dip tube. The outer surface of the outer wall of the adapter may include a sealing protrusion, and the inner surface of the sprayer connector may include a recess for matingly engaging the sealing protrusion. The upstream end of the inlet port may be a projection having flow holes. Optionally, the sprayer connector is integral with the inlet port of the sprayer.

In still another aspect, the invention provides a fluid container for attaching to a sprayer having an inlet port. The container may be sold as a separate refill container with a dip tube and without the sprayer. The container includes a bottom wall, side wall structure, and a neck having an opening. The bottom wall, the side wall structure, and the neck define an interior space of the container for holding liquid. The container also includes a container adapter having (i) a hollow inlet port that terminates at an downstream open end and that terminates at an upstream end, and (ii) an outer wall that terminates at an open end of the adapter opposite the upstream end of the inlet port of the adapter wherein the outer wall is connected to the inlet port, and an inner surface of the outer wall sealingly engages an outer surface of the neck of the container. The inlet port of the adapter may further comprise a dip tube that is separable from the inlet port of the adapter, and the downstream open end of the inlet port of the adapter may be dimensioned to sealingly engage the dip tube. The outer surface of the outer wall of the adapter may include a sealing protrusion, and the inner surface of the sprayer connector may include a recess for matingly engaging the sealing protrusion. The upstream end of the inlet port may be a projection having flow holes. Optionally, the sprayer connector is integral with the inlet port of the sprayer.

In yet another aspect, the invention provides a sprayer including a nozzle, an inlet port, and pumping means for delivering fluid from the inlet port to the nozzle. The sprayer further includes a sprayer connector having a fluid exit port, a fluid entry port, and a circular wall defining a flow conduit connecting the fluid exit port and the fluid entry port such that the fluid exit port is in fluid communication with the fluid entry port. An inner surface of the circular wall can have means for engaging sealing means on a container adapter. The sprayer connector is connected to the inlet port such that the fluid exit port is in fluid communication with the inlet port. The means for engaging can be an annular recess in an inner surface of the circular wall, or the means for engaging can be sealing ribs on an inner surface of the circular wall. In one form, the circular wall includes an inner sloping wall section, and the means for engaging includes an annular recess in the inner sloping wall section of the circular wall. In another form, the means for engaging comprises sealing ribs on the inner sloping wall section of the circular wall.

In still another aspect, the invention provides a device for placing an inlet port of a sprayer in fluid communication with an interior space of a container including a neck having an opening. The device includes a container adapter and a sprayer connector. The container adapter includes an outer wall that terminates at an open end of the adapter wherein the outer wall is dimensioned to engage the neck of the container, a hollow inlet port that terminates at an upstream open end and that terminates at a downstream open end, and a hollow inner wall connected to the outer wall and connected to the upstream open end of the inlet port. The inner wall of the container adapter includes a first alignment structure. The inner wall of the adapter can include a generally funnel shaped section. The sprayer connector has a flow conduit suitable for being placed in fluid communication with the inlet port of the sprayer and the adapter. The sprayer connector is dimensioned to matingly engage the inner wall of the adapter, and the sprayer connector includes a second alignment structure that mates with the first alignment structure of the inner wall of the adapter when the sprayer connector engages the adapter. The sprayer connector can be integral with the inlet port of the sprayer. The sprayer connector can include an outwardly extending exit port in fluid communication with the flow conduit wherein the exit port is dimensioned to sealingly engage the inlet port of the sprayer.

In one form of this device, the first alignment structure includes a depression in the inner wall of the adapter, and the second alignment structure includes an outward projection on an end wall of the sprayer connector. The projection enters the depression when the sprayer connector engages the adapter to thereby align the sprayer connector and the adapter is a specific angular relationship. The depression in the inner wall of the adapter can be offset from a central longitudinal axis of the adapter. The device can further include a dip tube, and the downstream open end of the inlet port of the adapter can be dimensioned to sealingly engage the dip tube. In one form, the inner wall of the adapter includes venting holes that form part of a vent path into the container. An outer surface of the sprayer connector can include at least one sealing rib for engaging the inner wall of the adapter, or an inner surface of the adapter can include at least one sealing rib for engaging the outer surface of the sprayer connector.

In yet another aspect, the invention provides a fluid container for attaching to a sprayer having an inlet port. The container includes a bottom wall, side wall structure, and a neck having an opening, wherein the bottom wall, the side wall structure, and the neck define an interior space of the container. The fluid container also has a container adapter including an outer wall that terminates at an open end of the adapter wherein the outer wall is dimensioned to engage the neck of the container, a hollow inlet port that terminates at an upstream open end and that terminates at a downstream open end, and a hollow inner wall connected to the outer wall and connected to the upstream open end of the inlet port wherein the inner wall includes an alignment structure. The inner wall of the adapter can include a generally funnel shaped section.

In one form, the alignment structure includes a depression in the inner wall of the adapter, and the depression in the inner wall of the adapter can be offset from a central longitudinal axis of the adapter. The inlet port of the adapter may further include a dip tube that is separable from the inlet port of the adapter, and the downstream open end of the inlet port of the adapter is dimensioned to sealingly engage the dip tube. The inner wall of the adapter can include venting holes that form part of a vent path into the container.

In still another aspect, the invention provides a sprayer including a nozzle, an inlet port, and a pump for delivering fluid from the inlet port to the nozzle. The sprayer further includes a sprayer connector having a sprayer connector including a fluid exit port, a fluid entry port, a flow conduit connecting the fluid exit port and the fluid entry port such that the fluid exit port is in fluid communication with the fluid entry port, and an outer wall and an end wall defining an interior space of the sprayer connector. The end wall includes an alignment structure, and the sprayer connector can be connected to the inlet port such that the fluid exit port is in fluid communication with the inlet port. The flow conduit can be offset from a central longitudinal axis of the sprayer connector. An outer surface of the sprayer connector can include at least one sealing rib. In one form, the alignment structure includes an outward projection on the end wall, and the outward projection on the end wall can be offset from a central longitudinal axis of the adapter.

These and other features, aspects, and advantages of the present invention will become better understood upon consideration of the following detailed description, drawings, and appended claims.

BRIEF DESCRIPTION OF THE DRAWINGS

Like reference numerals will be used to refer to like parts from Figure to Figure in the following description of the drawings.

DETAILED DESCRIPTION OF THE INVENTION

Figure 1:
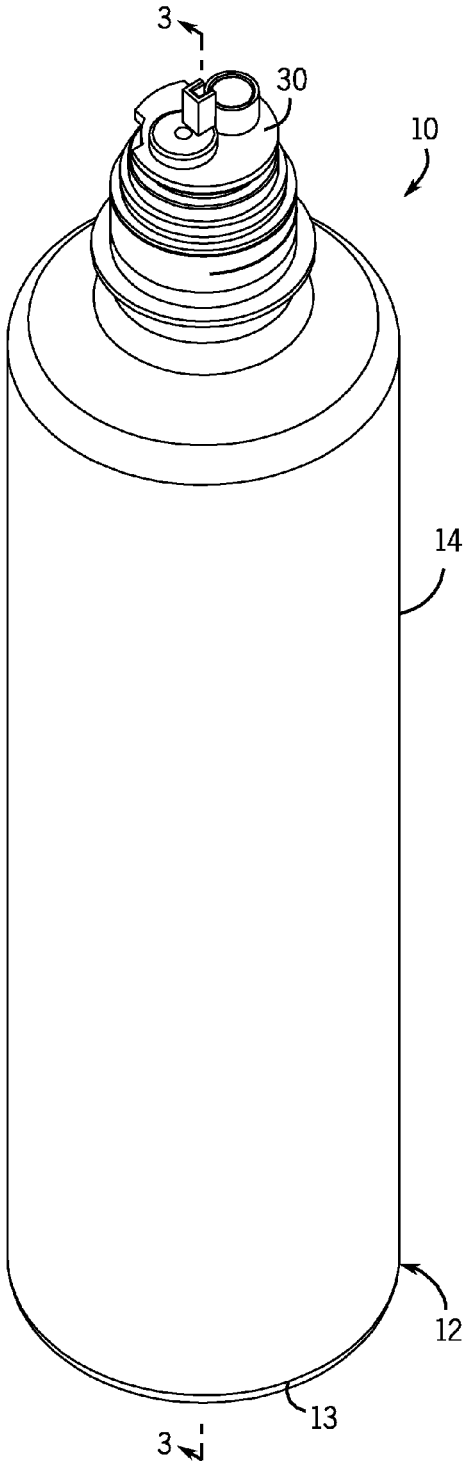
FIG. 1 is a perspective view of a device according to a first embodiment of the invention with a trigger sprayer head removed.
Figure 2:
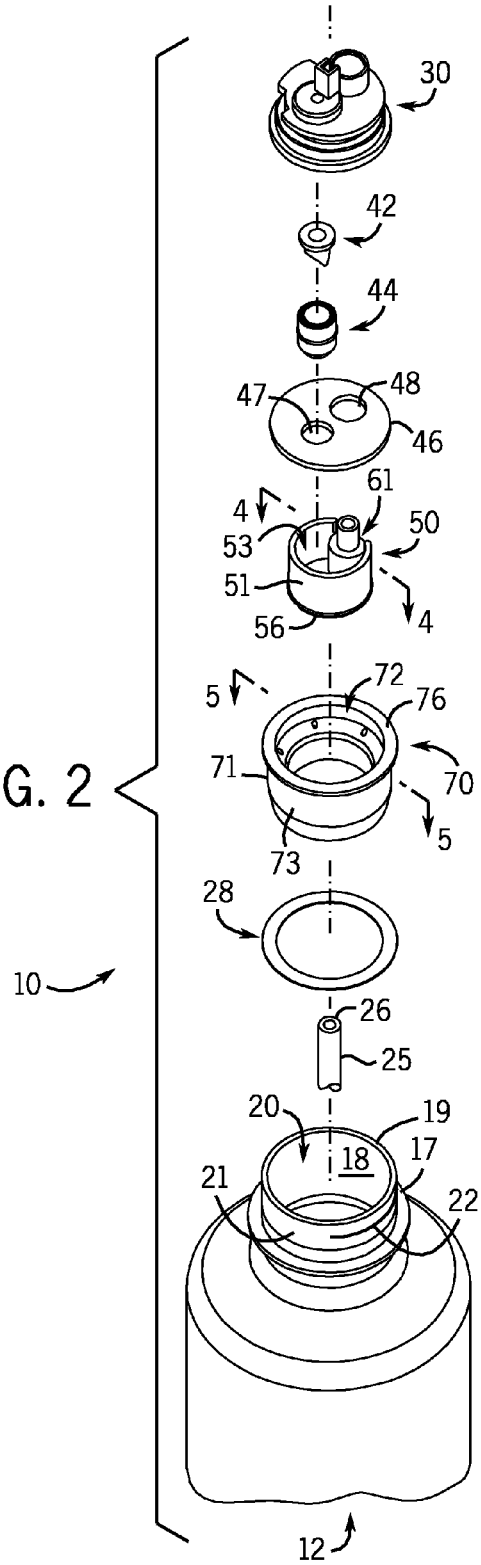
FIG. 2 is an exploded perspective view of the device of FIG. 1.

Turning first to FIGS. 1 to 5, there is shown an embodiment of a device 10 according to the invention. The device 10 may be used with a container 12 having a bottom wall 13 that is integral with a side wall 14. The bottom wall 13 and the side wall 14 define an interior space 15 of the container 12. The side wall 14 of the container 12 terminates at its upper end in a neck 17 having an inner surface 18 and a top surface 19 that define a container opening 20. The outer surface 21 of the container 12 has threads 22 for engaging a sprayer attachment cap as described below. A dip tube 25 with a downstream end 26 is provided for suctioning fluid from the interior space 15 of the container 12. An annular flat container gasket 28 is provided for sealing the top surface 19 of the neck 17 as described below. The container 12, the dip tube 25 and the container gasket 28 may be formed from plastic materials.

Figure 3:
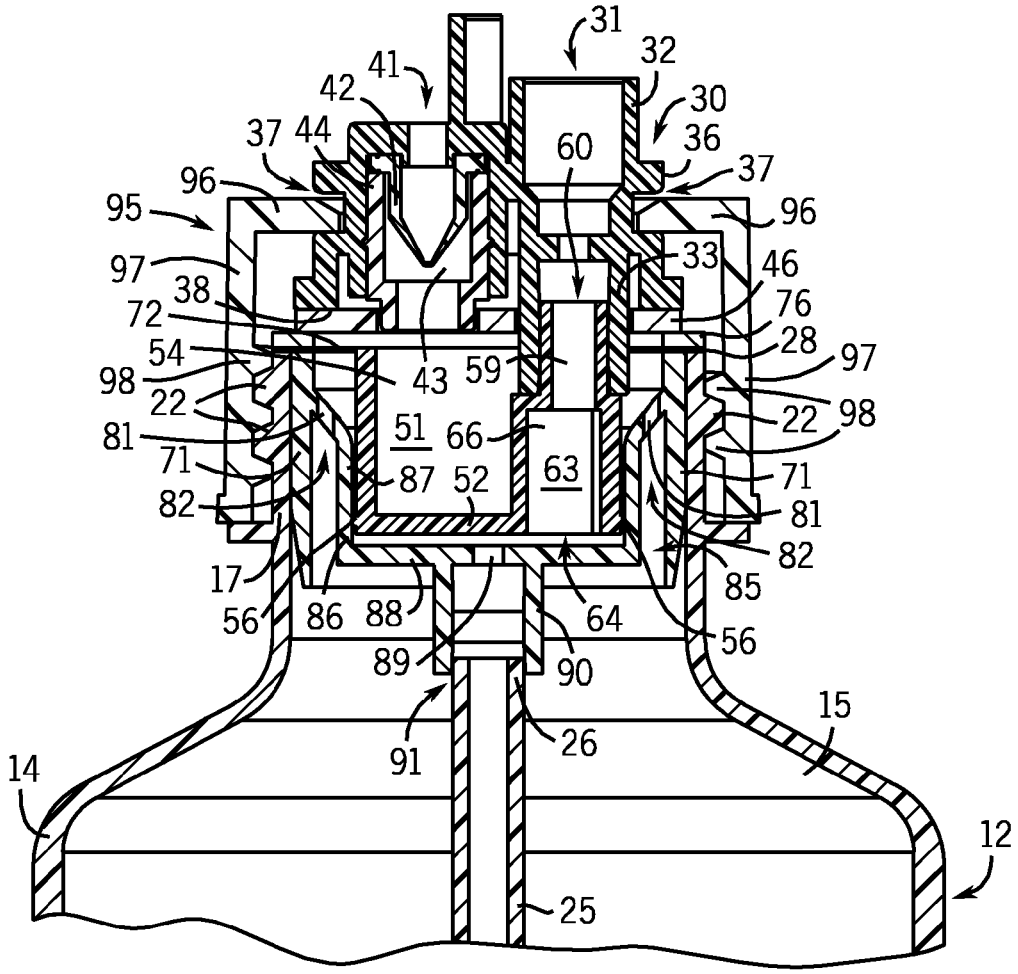
FIG. 3 is a cross-sectional view taken along line 3-3 of FIG. 1.
Figure 4:
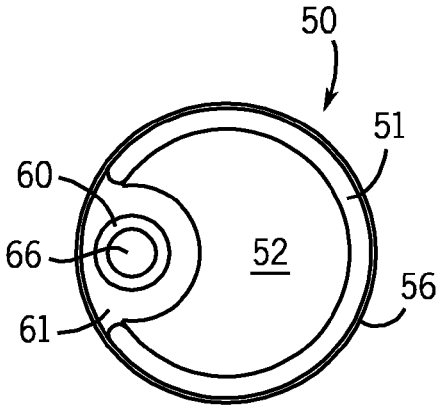
FIG. 4 is a top view of a sprayer connector of the device of the first embodiment of the invention taken along line 4-4 of FIG. 2.

The device 10 is suitable for use with a sprayer. In FIGS. 1 to 5, there is shown a generally circular sprayer base 30 for a sprayer such as that described in U.S. Patent Application Publication No. 2005/0133626. The specific sprayer selected for use with the invention is not critical and therefore, some sprayer parts other than the sprayer base 30 have been omitted for ease of illustration. The sprayer base 30 has an inlet port 31 including a downstream tubular end 32 and an upstream tubular end 33. The inlet port 31 provides an inlet fluid path that provides fluid to the pump of the sprayer such that the pump can spray the fluid out of the sprayer nozzle as is well known in the art. The sprayer base 30 also includes an outer wall 36 with an annular recess 37 for mounting a sprayer cap as described below, and a lower surface 38. The sprayer base 30 also has a venting valve assembly 41 that provides a vent path such that air may pass downward through the sprayer base 30. The venting valve assembly 41 is constructed by placing a duckbill valve 42 in vent passageway 43 of the sprayer base 30. A valve cover 44 secures the duckbill valve 42 in the vent passageway 43 as shown in FIG. 3. A disc-like sprayer gasket 46 is also included for sealing the lower surface 38 of the sprayer base 30. The sprayer gasket 46 has a vent hole 47 for surrounding the valve cover 44 and a sprayer port hole 48 for surrounding the inlet port 31 of the sprayer base 30. The sprayer base 30, duckbill valve 42, valve cover 44 and sprayer gasket 46 may be formed from plastic materials.

Referring still to FIGS. 1 to 5, the device 10 according to the invention includes a sprayer connector 50 that connects to the upstream tubular end 33 of the inlet port 31 of the sprayer base 30. The sprayer connector 50 has a tubular outer wall 51 that terminates at one end in a bottom wall 52 and that terminates at an opposite end in an open top end 53. The outer wall 51 and the bottom wall 52 define an interior 54 of the sprayer connector 50. The outer wall 51 of the sprayer connector 50 has an outwardly projecting circumferential rib 56 near the bottom wall 52 of the sprayer connector 50. The sprayer connector 50 includes an upper inner tubular section 59 that terminates in a fluid exit port 60 of the sprayer connector 50. The outer wall 51 of the sprayer connector 50 has an outer wall cutaway section 61 that provides a fluid path out of the interior 54 of the sprayer connector 50 around the outside of the upper inner tubular section 59. The sprayer connector 50 includes a lower inner tubular section 63 that terminates in a fluid entry port 64 of the sprayer connector 50. The upper inner tubular section 59, the fluid exit port 60, the lower inner tubular section 63 and the fluid entry port 64 define an end to end flow conduit 66 in the sprayer connector 50. The sprayer connector 50 may be formed from a plastic material such as acrylonitrile butadiene styrene (ABS) or like material.

Still looking at FIGS. 1 to 5, the device 10 according to the invention includes a container adapter 70 that connects to the neck 17 of the container 12. The container adapter 70 has a cylindrical outer wall 71 that terminates in a downstream open end 72. The outer wall 71 of the container adapter 70 has an outer surface 73 that engages the inner surface 18 of the neck 17 of the container 12 when the container adapter 70 is assembled to the container 12 as shown in FIG. 3. An annular flange 76 extends outwardly from the outer wall 71 of the container adapter 70 at the downstream open end 72 of the container adapter 70. The flange 76 engages the flat container gasket 28 on the top surface 19 of the neck 17 of the container 12 when the container adapter 70 is assembled to the container 12 as shown in FIG. 3. The container adapter 70 also includes a sloping inner wall 81 that is connected to the outer wall 71 and that defines an annular space 82 between the inner wall 81 and the outer wall 71. Venting holes 83 are provided in the inner wall 81. The venting holes 83 provide an air path between the downstream open end 72 of the container adapter 70 and the annular space 82 between the inner wall 81 and the outer wall 71. The container adapter 70 also includes an inlet port 85 that is connected to the inner wall 81. The inlet port 85 has an upper tubular section 86 that terminates in an upstream open end 87 and that terminates at an opposite end at a bottom wall 88. A central hole 89 is provided in the bottom wall 88 and leads to a lower tubular section 90 of the inlet port 85. The lower tubular section 90 terminates in a downstream open end 91 of the inlet port 85 which receives the dip tube 25 in a friction fit. The container adapter 70 can be made of a plastic material such as polyethylene or polypropylene.

Figure 3A:
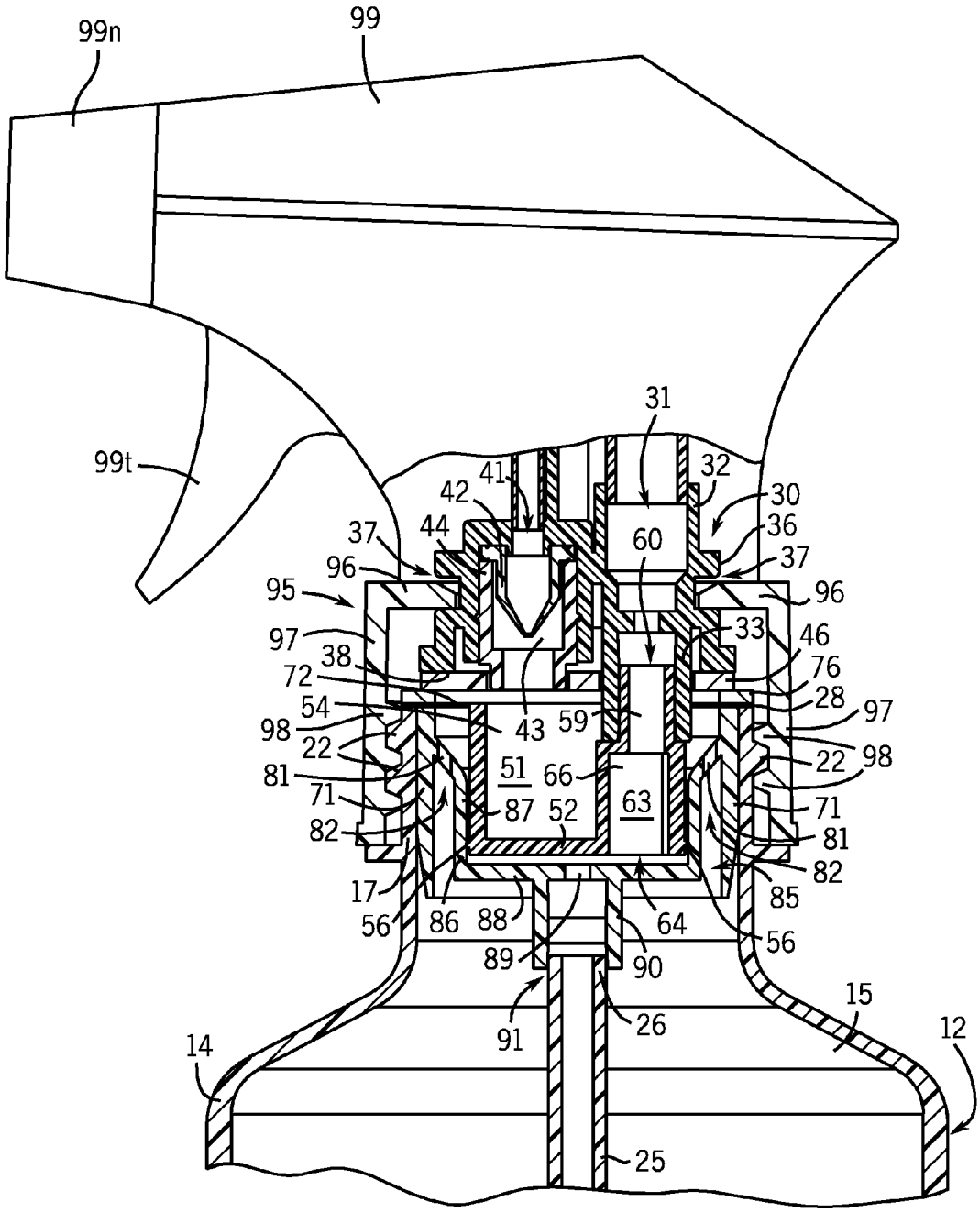
FIG. 3A is a cross-sectional view similar to FIG. 3 with a sprayer head shown on the device.
Figure 6:
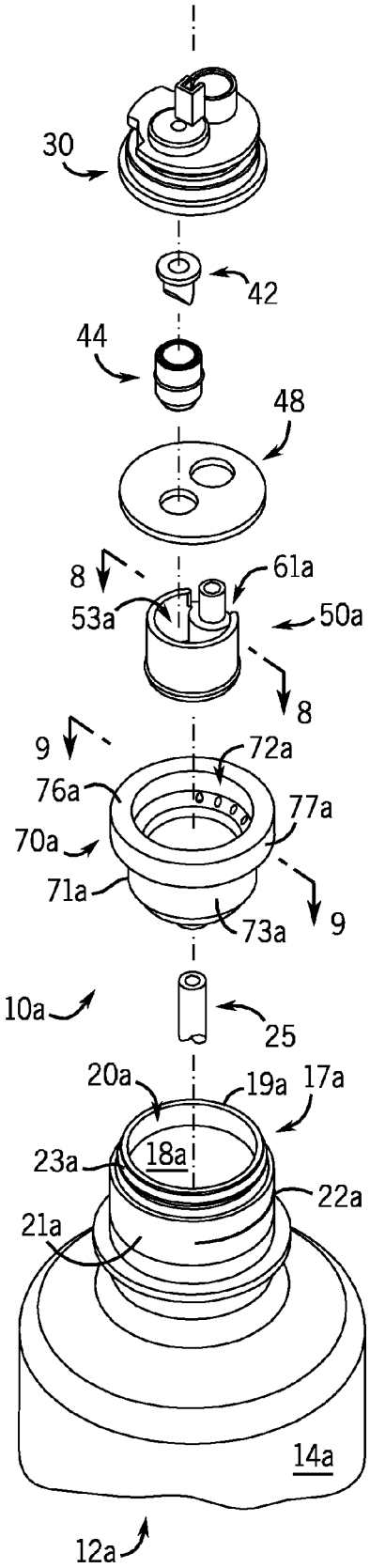
FIG. 6 is an exploded perspective view of a device according to a second embodiment of the invention.
Figure 8:
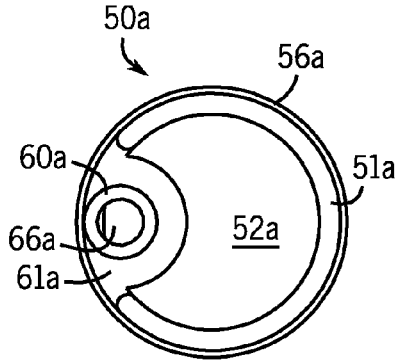
FIG. 8 is a top view of a sprayer connector of the device of the second embodiment of the invention taken along line 8-8 of FIG. 6.
Figure 9:
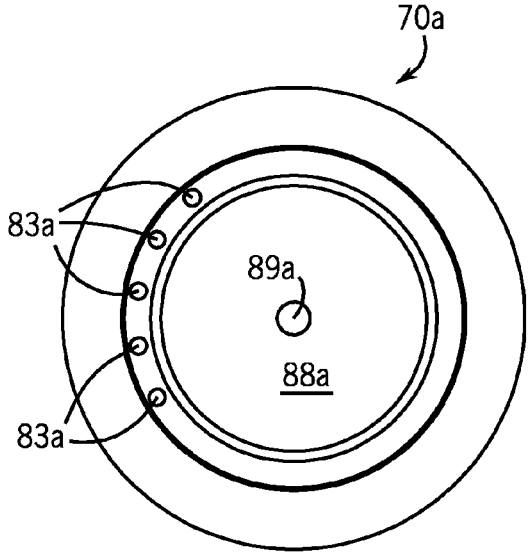
FIG. 9 is a top view of a container adapter of the device of the second embodiment of the invention taken along line 9-9 of FIG. 6.

A sprayer attachment cap 95 is provided for securing the sprayer base 30 of the sprayer to the neck 17 of the container 12 as shown in FIG. 3. The cap 95 has an annular top wall 96 and a cylindrical skirt 97 that depends downward from the top wall 96. The inner surface of the skirt 97 has threads 98 that engage the threads 22 on the outer surface 21 of the container 12 when the sprayer is assembled to the container 12. The inner edge of the annular top wall 96 of the cap 95 is secured for rotating movement in the annular recess 37 of the outer wall 36 of the sprayer base 30. FIG. 3A shows a sprayer 99 with the sprayer attachment cap 95. The sprayer 99 has the usual nozzle 99*n* and trigger 99*t*. Pumping means for delivering fluid from the inlet port 31 of the sprayer 99 to the nozzle 99*n* of the sprayer 99 by way of actuation of the trigger 99*t* are known in the art and therefore will not be explained further.

Assembly of a sprayer to the container 12 proceeds as follows. A sprayer is selected with a sprayer base such as the sprayer base 30 and a cap such as cap 95 mounted on the sprayer base 30. The venting valve assembly 41 is constructed by placing a duckbill valve 42 in vent passageway 43 of the sprayer base 30 and then securing the valve cover 44 over the duckbill valve 42 in the vent passageway 43 as shown in FIG. 3. The disc-like sprayer gasket 46 is then placed on the lower surface 38 of the sprayer base 30. The exit port 60 of the sprayer connector 50 is then inserted into the downstream tubular end 32 of the sprayer base 30 as shown in FIG. 3. The sprayer connector 50 and the sprayer base 30 may be separate parts as shown in FIGS. 1 to 5 or alternatively, the sprayer connector 50 and the sprayer base 30 may be integrally formed as a single piece. In this manner, a sprayer with the sprayer connector 50 is provided for connection to the container 12.

The container adapter 70 is assembled to the container 12. The dip tube 25 is inserted into the downstream open end 91 of the inlet port 85 of the container adapter 70 in a friction fit. Alternatively, the container adapter 70 and the dip tube 25 may be integrally formed as a single piece, or may be secured together such as by adhesive or friction welding. The container adapter 70 and the dip tube 25 are then inserted into the opening 20 of the container 12 so that the outer surface 73 of the outer wall 71 of the container adapter 70 engages the inner surface 18 of the neck 17 of the container 12 as shown in FIG. 3. The annular flange 76 engages the flat container gasket 28 on the top surface 19 of the neck 17 of the container 12 as shown in FIG. 3. In this manner, a container 12 with a container adapter 70 and attached dip tube 25 is provided for connection to a sprayer with the sprayer connector 50.

In an example automated assembly of the sprayer with the sprayer connector 50 to the container 12 with the container adapter 70 and attached dip tube 25, a plurality of the containers 12 with the container adapter 70 and attached dip tube 25 travel on a conveyor. A sprayer 99 with the sprayer connector 50 is then lowered over each container 12 with the container adapter 70 and attached dip tube 25. The outer wall 51 of the sprayer connector 50 is aligned with the upper tubular section 86 of the inlet port 85 of the container adapter 70. The sprayer connector 50 is then lowered into the container adapter 70 such that the rib 56 on the outer wall 51 of the sprayer connector 50 seals with the inner surface of the upper tubular section 86 of the inlet port 85 of the container adapter 70. The cap 95 is then automatically threaded on the threads 22 on the outer surface 21 of the container 12 to secure the sprayer 99 to the container 12. While the invention has been illustrated herein with a threaded cap 95, alternative means are suitable for attaching the sprayer to the container. For example, bayonet-type couplings have been used to couple a sprayer and a container. U.S. Pat. No. 6,138,873 shows an example bayonet-type coupling.

The container adapter 70 is dimensioned to provide for easier automated assembly. For example, the sloping inner wall 81 of the container adapter 70 guides the outer wall 51 of the sprayer connector 50 into the upper tubular section 86 of the inlet port 85 of the container adapter 70. Also, the inside diameter of the upper tubular section 86 of the inlet port 85 of the container adapter 70 may decrease from top to bottom to further guide the outer wall 51 of the sprayer connector 50 into the bottom region of the upper tubular section 86 of the inlet port 85 of the container adapter 70 wherein the rib 56 engages the inner surface of the upper tubular section 86 of the inlet port 85 of the container adapter 70.

Figure 5:
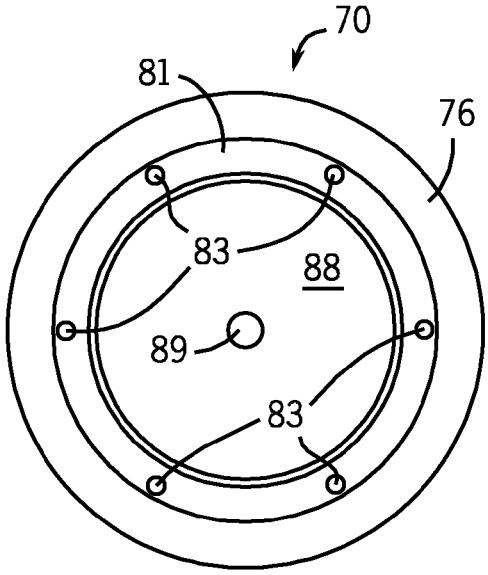
FIG. 5 is a top view of a container adapter of the device of the first embodiment of the invention taken along line 5-5 of FIG. 2.

Referring to FIG. 5, fluid flow in the device 10 is as follows during use of the assembled device. When the sprayer 99 is actuated (for example, by repeatedly pulling a manual trigger that operates a pump or by pulling a trigger switch that activates an electric pump), liquid in the interior space 15 of the container 12 is suctioned up through dip tube 25. The liquid then enters the lower tubular section 90 of the inlet port 85, passes through the central hole 89, and enters the bottom of the upper tubular section 86 of the inlet port 85. The liquid then enters the fluid entry port 64 of the sprayer connector 50 and flows into the lower inner tubular section 63 of the sprayer connector 50. Because the rib 56 seals against the inner surface of the upper tubular section 86 of the inlet port 85 of the container adapter 70, liquid is prevented from flowing above the rib 56 between the inner surface of the upper tubular section 86 of the inlet port 85 of the container adapter 70 and the outer wall 51 of the sprayer connector 50. From the lower inner tubular section 63 of the sprayer connector 50, the liquid flows into the upper inner tubular section 59 of the sprayer connector 50 and exits the fluid exit port 60. The liquid flows into the upstream tubular end 33 of the inlet port 31 of the sprayer base 30 and then into downstream tubular end 32 of the sprayer base 30. The liquid then enters the pumping system (not shown) of the sprayer 99 for spraying out of the nozzle 99*n* of the sprayer 99.

As the sprayer 99 is actuated and liquid is removed from the interior space 15 of the container 12, negative pressure may result in the container 12. The pressure differential is eliminated by way of the venting valve assembly 41 and the venting holes 83 in the container adapter 70. Because of the negative pressure, the duckbill valve 42 opens and air passes downward through the duckbill valve 42 into the vent passageway 43 of the sprayer base 30. The air then travels into the downstream open end 72 of the container adapter 70 and then into the annular space 82 between the inner wall 81 and the outer wall 71 of the container adapter 70 by way of the venting holes 83. The air then enters the interior space 15 of the container 12 equalizing the pressure inside and outside the container 12.

Because the rib 56 seals against the inner surface of the upper tubular section 86 of the inlet port 85 of the container adapter 70, air is prevented from flowing below the rib 56 between the inner surface of the upper tubular section 86 of the inlet port 85 of the container adapter 70 and the outer wall 51 of the sprayer connector 50. Thus, the rib 56 serves to establish and maintain independent liquid and air flow paths when the container adapter 70 and the sprayer connector 50 are assembled together. Alternatively, an inner surface of the adapter 70 may include a sealing rib for engaging the outer surface of the sprayer connector 50. Also, the rib may take the form of an O-ring.

The mating dimensions of the sprayer connector 50 and the container adapter 70 also provide keying structures that ensure that only refills containing a liquid appropriate for a particular purpose are used with the sprayer. Specifically, a tight fit is required between the sprayer connector 50 and the container adapter 70 so that the sprayer may be primed with liquid by way of the dip tube 25. If air leakage were to occur between the inner surface of the upper tubular section 86 of the inlet port 85 of the container adapter 70 and the outer wall 51 of the sprayer connector 50, the sprayer would suck air into the sprayer rather than liquid. Therefore, only refills comprising a container 12 with an attached container adapter 70 that mates with the sprayer connector 50 of the sprayer 99 would be suitable for use with the container.

Turning now to FIGS. 6 to 9, there is shown a second embodiment of a device 10*a* according to the invention. The device 10*a* may be used with a container 12*a* having a bottom wall that is integral with a side wall as in container 12 of FIG. 1. The bottom wall and the side wall 14*a* define an interior space 15*a* of the container 12*a*. The side wall 14*a* of the container 12*a* terminates at its upper end in a neck 17*a* having an inner surface 18*a* and a top surface 19*a* that define a container opening 20*a*. The outer surface 21*a* of the neck 17*a* of the container 12*a* has threads 22*a* for engaging a sprayer cap as described below. The outer surface 21*a* of the neck 17*a* of the container 12*a* also has an annular groove 23*a* for engaging a container adapter 70*a* as described below. A dip tube 25 as in FIGS. 1-5 is provided for suctioning fluid from the interior space 15*a* of the container 12*a*. The container 12*a* may be formed from plastic materials.

The device 10*a* is suitable for use with a sprayer. In FIGS. 6 to 9, there is shown a generally circular sprayer base 30 for a sprayer such as that described above with reference to FIGS. 1 to 5. Therefore, a description of the sprayer base 30 in FIGS. 6-9 is the same as that provided above for FIGS. 1-5.

Referring still to FIGS. 6 to 9, the device 10*a* according to the invention includes a sprayer connector 50*a* that connects to the upstream tubular end 33 of the inlet port 31 of the sprayer base 30 as in the embodiment of FIGS. 1-5. The sprayer connector 50*a* has a tubular outer wall 51*a* that terminates at one end in a bottom wall 52*a* and that terminates at an opposite end in an open top end 53*a*. The outer wall 51*a* and the bottom wall 52*a* define an interior 54*a* of the sprayer connector 50*a*. The outer wall 51*a* of the sprayer connector 50*a* has an outwardly projecting rib 56*a* near the bottom wall 52*a* of the sprayer connector 50*a*. The sprayer connector 50*a* includes an upper inner tubular section 59*a* that terminates in a fluid exit port 60*a* of the sprayer connector 50*a*. The outer wall 51*a* of the sprayer connector 50*a* has an outer wall cutaway section 61*a* that provides a fluid path out of the interior 54*a* of the sprayer connector 50*a*. The sprayer connector 50*a* includes a lower inner tubular section 63*a* that terminates in a fluid entry port 64*a* of the sprayer connector 50*a*. The upper inner tubular section 59*a*, the fluid exit port 60*a*, the lower inner tubular section 63*a* and the fluid entry port 64*a* define a flow conduit 66*a* in the sprayer connector 50*a*. The sprayer connector 50*a* may be formed from a plastic material such as ABS or like material.

Figure 7:
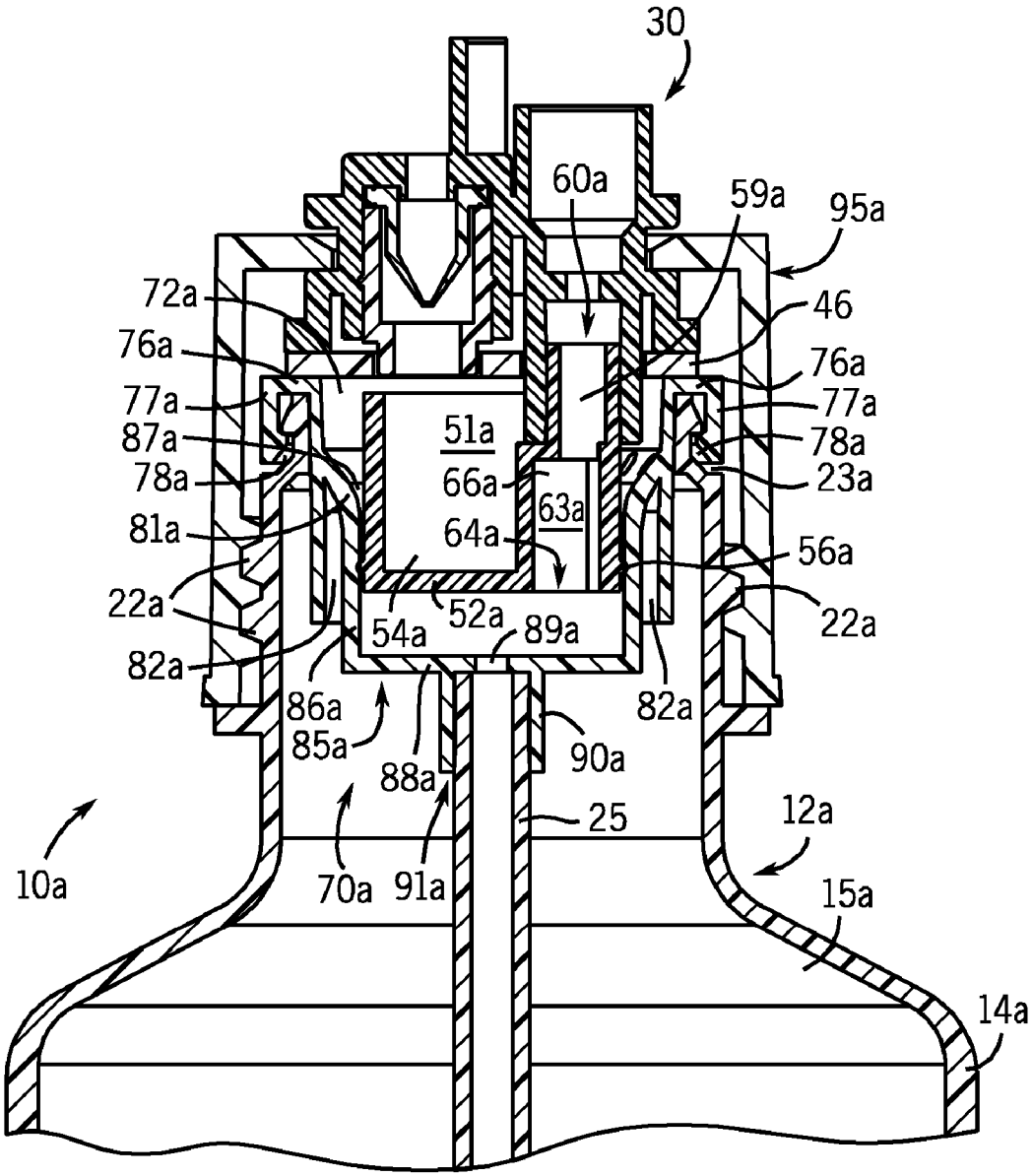
FIG. 7 is a cross-sectional view similar to that of FIG. 3 of the device of FIG. 6.

Still looking at FIGS. 6 to 9, the device 10*a* according to the invention includes a container adapter 70*a* that connects to the neck 17*a* of the container 12*a*. The container adapter 70*a* has a cylindrical outer wall 71*a* that terminates in a downstream open end 72*a*. The outer wall 71*a* of the container adapter 70 has an outer surface 73*a* that engages the inner surface 18*a* of the neck 17*a* of the container 12*a* as shown in FIG. 7. An annular flange 76*a* extends outwardly from the outer wall 71*a* at the downstream open end 72*a* of the container adapter 70*a*. The flange 76*a* engages the top surface 19*a* of the neck 17*a* of the container 12*a* as shown in FIG. 7. A skirt 77*a* extends longitudinally downward from the outer edge of the flange 76*a*. The skirt 77*a* terminates at its lower end in an inwardly directed circumferential rib 78*a* that engages groove 23*a* of the container 12*a* as described below.

The container adapter 70*a* also includes a sloping inner wall 81*a* that is connected to the outer wall 71*a* and that defines an annular space 82*a* between the inner wall 81*a* and the outer wall 71*a*. Venting holes 83*a* are provided in the inner wall 81*a*. The venting holes 83*a* provide an air path between the downstream open end 72*a* of the container adapter 70*a* and the annular space 82*a* between the inner wall 81*a* and the outer wall 71*a*. The container adapter 70*a* also includes an inlet port 85*a* that is connected to the inner wall 81*a*. The inlet port 85*a* has an upper tubular section 86*a* that terminates in an upstream open end 87*a* and that terminates at an opposite end at a bottom wall 88*a*. A central hole 89*a* is provided in the bottom wall 88*a* and leads to a lower tubular section 90*a* of the inlet port 85*a*. The lower tubular section 90*a* terminates in a downstream open end 91*a* of the inlet port 85*a* which receives the dip tube 25 in a friction fit. The container adapter 70*a* can be made of a plastic material such as polyethylene or polypropylene.

A cap 95*a* is provided for securing the sprayer base 30 of the sprayer to the neck 17*a* of the container 12*a* as shown in FIG. 7. The cap 95*a* has an annular top wall 96*a* and a cylindrical skirt 97*a* that depends downward from the top wall 96*a*. The inner surface of the skirt 97*a* has threads 98*a* that engage the threads 22*a* on the outer surface 21*a* of the container 12*a* when the sprayer is assembled to the container 12*a*. The inner edge of the annular top wall 96*a* of the cap 95*a* is secured for rotating movement in the annular recess 37 of the outer wall 36 of the sprayer base 30.

Assembly of a sprayer to the container 12*a* proceeds as follows. A sprayer is selected with a sprayer base such as the sprayer base 30 and a cap such as cap 95*a* mounted on the sprayer base 30. The venting valve assembly 41 is constructed as in the embodiment of FIGS. 1-5. The disc-like sprayer gasket 46 is then placed on the lower surface 38 of the sprayer base 30. The exit port 60*a* of the sprayer connector 50*a* is then inserted into the downstream tubular end 32 of the sprayer base 30 as shown in FIG. 7. The sprayer connector 50*a* and the sprayer base 30 may be separate parts as shown in FIGS. 6 to 9 or alternatively, the sprayer connector 50*a* and the sprayer base 30 may be integrally formed as a single piece. In this manner, a sprayer with the sprayer connector 50*a* is provided for connection to the container 12*a*.

The container adapter 70*a* is assembled to the container 12*a*. The dip tube 25 is inserted into the downstream open end 91*a* of the inlet port 85*a* of the container adapter 70*a* in a friction fit. Alternatively, the container adapter 70*a* and the dip tube 25 may be integrally formed as a single piece, or may be secured together such as by adhesive or friction welding. The container adapter 70*a* and the dip tube 25 are then inserted into the opening 20*a* of the container 12*a* so that the outer surface 73*a* of the outer wall 71*a* of the container adapter 70*a* engages the inner surface 18*a* of the neck 17*a* of the container 12*a* and so that the circumferential rib 78*a* of the skirt 77*a* of the container adapter 70*a* enters the groove 23*a* at the top of the container 12*a* as shown in FIG. 7. The annular flange 76*a* engages the top surface 19*a* of the neck 17*a* of the container 12*a* as shown in FIG. 7. In this manner, a container 12*a* with a container adapter 70*a* and attached dip tube 25 is provided for connection to a sprayer with the sprayer connector 50*a*.

In an example automated assembly of the sprayer with the sprayer connector 50*a* to the container 12*a* with the container adapter 70*a* and attached dip tube 25, a plurality of the containers 12*a* with the container adapter 70*a* and attached dip tube 25 travel on a conveyor. A sprayer with the sprayer connector 50*a* is then lowered over each container 12*a* with the container adapter 70*a* and attached dip tube 25. The outer wall 51*a* of the sprayer connector 50*a* is aligned with the upper tubular section 86*a* of the inlet port 85*a* of the container adapter 70*a*. The sprayer connector 50*a* is then lowered into the container adapter 70*a* such that the rib 56*a* on the outer wall 51*a* of the sprayer connector 50*a* seals with the inner surface of the upper tubular section 86*a* of the inlet port 85*a* of the container adapter 70*a*. The cap 95*a* is then automatically threaded on the threads 22*a* on the outer surface 21*a* of the container 12*a* to secure the sprayer to the container 12*a*.

As with container adapter 70, the container adapter 70*a* is dimensioned to provide for easier automated assembly. The sloping inner wall 81*a* of the container adapter 70*a* guides the outer wall 51*a* of the sprayer connector 50*a* into the upper tubular section 86*a* of the inlet port 85*a* of the container adapter 70*a*. Also, the inside diameter of the upper tubular section 86*a* of the inlet port 85*a* of the container adapter 70*a* may decrease from top to bottom to further guide the outer wall 51*a* of the sprayer connector 50*a* into the bottom region of the upper tubular section 86*a* of the inlet port 85*a* of the container adapter 70*a* wherein the rib 56*a* engages the inner surface of the upper tubular section 86*a* of the inlet port 85*a* of the container adapter 70*a*.

Referring to FIG. 7, fluid flow in the device 10*a* is as follows during use of the assembled device. Liquid in the interior space 15*a* of the container 12*a* is suctioned up through dip tube 25. The liquid then enters the lower tubular section 90*a* of the inlet port 85*a*, passes through the central hole 89*a*, and enters the bottom of the upper tubular section 86*a* of the inlet port 85*a*. The liquid then enters the fluid entry port 64*a* of the sprayer connector 50*a* and flows into the lower inner tubular section 63*a* of the sprayer connector 50*a*. Because the rib 56*a* seals against the inner surface of the upper tubular section 86*a* of the inlet port 85*a* of the container adapter 70*a*, liquid is prevented from flowing above the rib 56*a* between the inner surface of the upper tubular section 86*a* of the inlet port 85*a* of the container adapter 70*a* and the outer wall 51*a* of the sprayer connector 50*a*. From the lower inner tubular section 63*a* of the sprayer connector 50*a*, the liquid flows into the upper inner tubular section 59*a* of the sprayer connector 50*a* and exits the fluid exit port 60*a*. The liquid flows into the upstream tubular end 33 of the inlet port 31 of the sprayer base 30 and then into downstream tubular end 32 of the sprayer base 30. The liquid then enters the pumping system (not shown) of the sprayer for spraying out of the nozzle of the sprayer.

As the sprayer is actuated and liquid is removed from the interior space 15*a* of the container 12*a*, negative pressure may result in the container 12*a*. The pressure differential is eliminated by way of the venting valve assembly 41 and the venting holes 83*a* in the container adapter 70*a*. Because of the negative pressure, the duckbill valve 42 opens and air passes downward through the duckbill valve 42 into the vent passageway 43 of the sprayer base 30. The air then travels into the downstream open end 72*a* of the container adapter 70*a* and then into the annular space 82*a* between the inner wall 81*a* and the outer wall 71*a* of the container adapter 70*a* by way of the venting holes 83*a*. The air then enters the interior space 15*a* of the container 12*a* equalizing the pressure inside and outside the container 12*a*.

Because the rib 56*a* seals against the inner surface of the upper tubular section 86*a* of the inlet port 85*a* of the container adapter 70*a*, air is prevented from flowing below the rib 56*a* between the inner surface of the upper tubular section 86*a* of the inlet port 85*a* of the container adapter 70*a* and the outer wall 51*a* of the sprayer connector 50*a*. Thus, the rib 56*a* serves to establish and maintain independent liquid and air flow paths when the container adapter 70*a* and the sprayer connector 50*a* are assembled together.

The mating dimensions of the sprayer connector 50*a* and the container adapter 70*a* also provide keying structures that ensure that only refills containing a liquid appropriate for a particular purpose are used with the sprayer. Specifically, a tight fit is required between the sprayer connector 50*a* and the container adapter 70*a* so that the sprayer may be primed with liquid by way of the dip tube 25. If air leakage were to occur between the inner surface of the upper tubular section 86*a* of the inlet port 85*a* of the container adapter 70*a* and the outer wall 51*a* of the sprayer connector 50*a*, the sprayer would suck air into the sprayer rather than liquid. Therefore, only refills comprising a container 12*a* with an attached container adapter 70*a* that mates with the sprayer connector 50*a* of the sprayer would be suitable for use with the container 12*a*.

Figure 10:
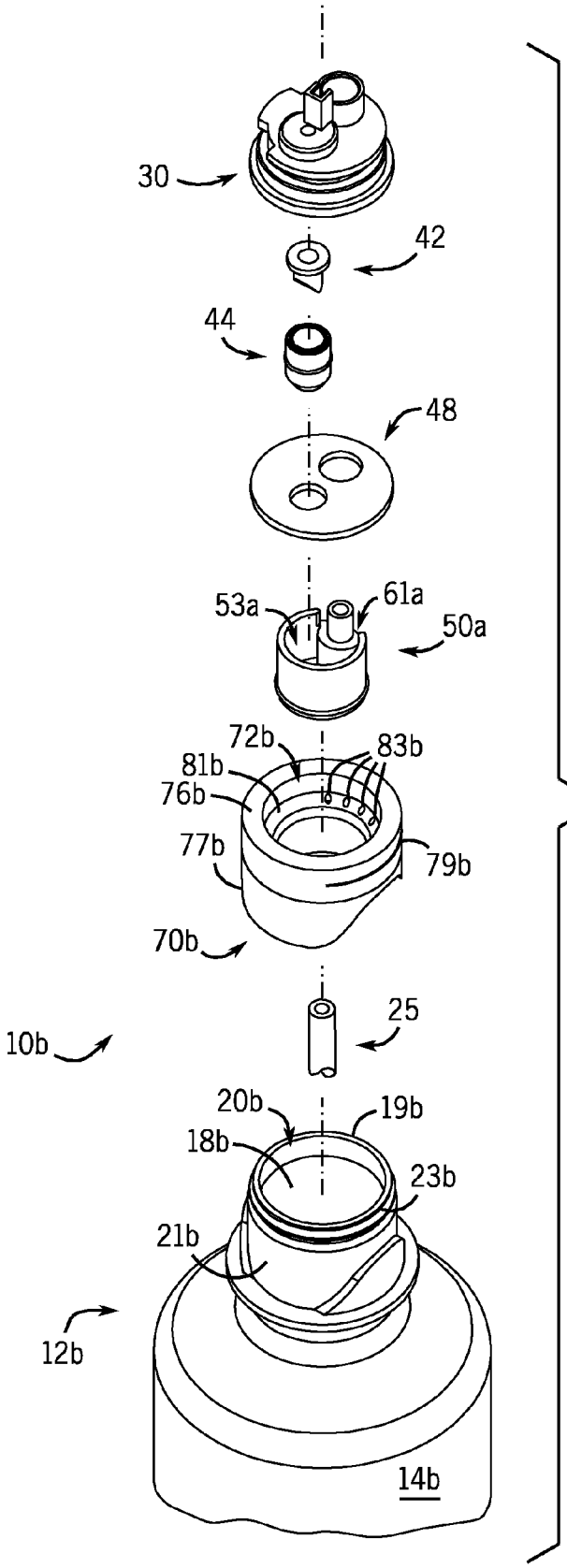
FIG. 10 is an exploded perspective view of a device according to a third embodiment of the invention.
Figure 11:
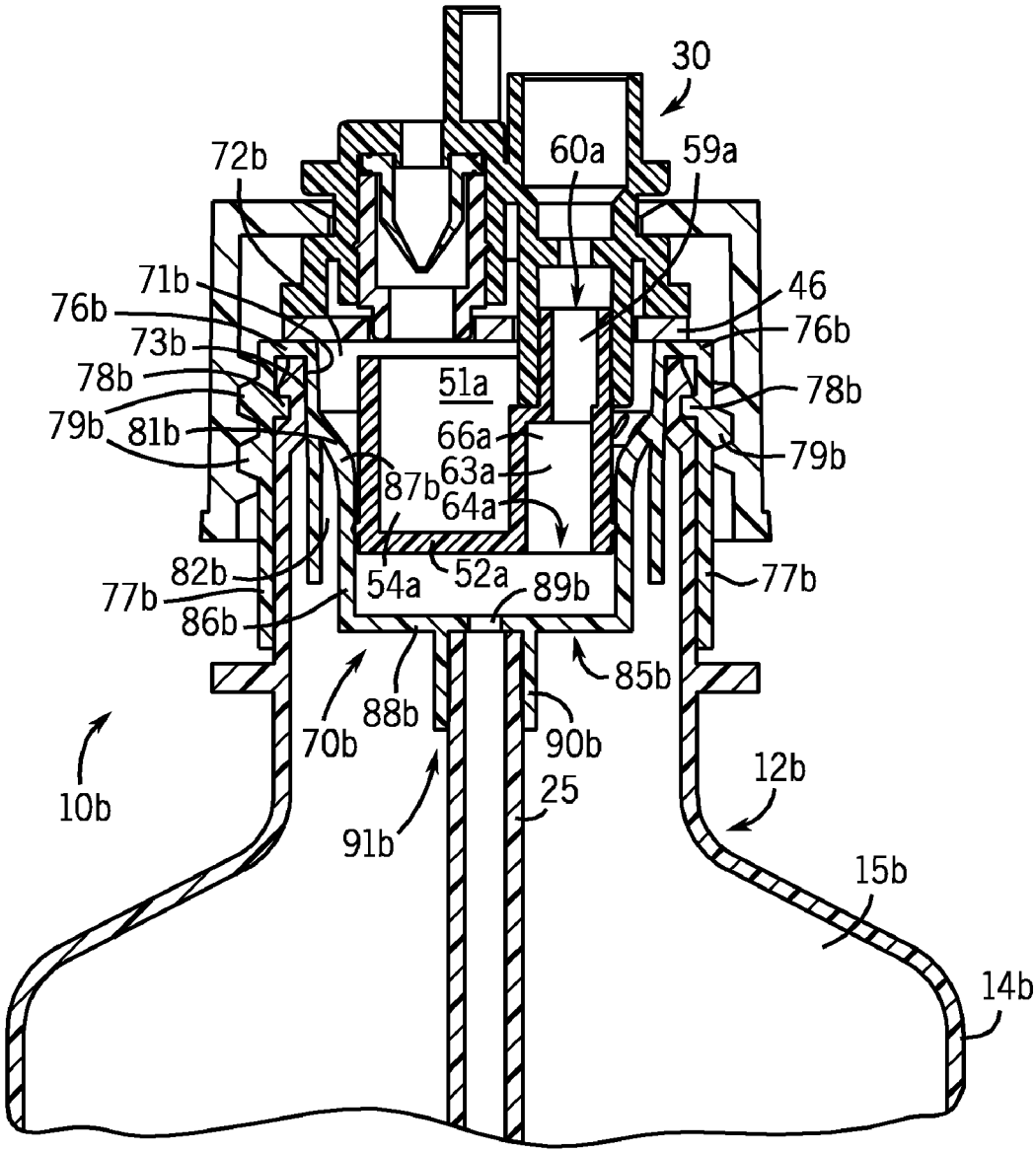
FIG. 11 is a cross-sectional view similar to that of FIG. 3 of the device of FIG. 10.

Turning now to FIGS. 10 and 11, there is shown a third embodiment of a device 10*b* according to the invention. The device 10*b* may be used with a container 12*b* having a bottom wall that is integral with a side wall as in container 12 of FIG. 1. The bottom wall and the side wall 14*b* define an interior space 15*b* of the container 12*b*. The side wall 14*b* of the container 12*b* terminates at its upper end in a neck 17*b* having an inner surface 18*b* and a top surface 19*b* that define a container opening 20*b*. The outer surface 21*b* of the neck 17*b* of the container 12*b* also has an annular groove 23*b* for engaging a container adapter 70*b* as described below. A dip tube 25 as in FIGS. 1-5 is provided for suctioning fluid from the interior space 15*b* of the container 12*b*. The container 12*b* may be formed from plastic materials.

The device 10*b* is suitable for use with a sprayer. In FIGS. 10 and 11, there is shown a generally circular sprayer base 30 for a sprayer such as that described above with reference to FIGS. 1-5. Therefore, a description of the sprayer base 30 in FIGS. 10 and 11 is identical to that provided above for FIGS. 1 to 5.

Referring still to FIGS. 10 and 11, the device 10*b* according to the invention includes a sprayer connector 50*a* that connects to the upstream tubular end 33 of the inlet port 31 of the sprayer base 30 as in the embodiment of FIGS. 6 to 9. Therefore, a description of the sprayer connector 50*a* in FIGS. 10-11 is identical to that provided above for FIGS. 6-9.

Still looking at FIGS. 10 and 11, the device 10*b* according to the invention includes a container adapter 70*b* that connects to the neck 17*b* of the container 12*b*. The container adapter 70*b* has a cylindrical outer wall 71*b* that terminates in a downstream open end 72*b*. The outer wall 71*b* of the container adapter 70 has an outer surface 73*b* that engages the inner surface 18*b* of the neck 17*b* of the container 12*b* as shown in FIG. 7. An annular flange 76*b* extends outwardly from the outer wall 71*b* at the downstream open end 72*b* of the container adapter 70*b*. The flange 76*b* engages the neck 17*b* of the container 12*b* as shown in FIG. 7. A skirt 77*b* extends longitudinally downward from the outer edge of the flange 76*b*. The skirt 77*b* has at its upper inner end in an inwardly directed circumferential rib 78*b* that engages groove 23*b* of the container 12*b*. The outer surface of the skirt 77*b* has threads 79*b* for engaging a sprayer cap as described below.

The container adapter 70*b* also includes a sloping inner wall 81*b* that is connected to the outer wall 71*b* and that defines an annular space 82*b* between the inner wall 81*b* and the outer wall 71*b*. Venting holes 83*b* are provided in the inner wall 81*b*. The venting holes 83*b* provide an air path between the downstream open end 72*b* of the container adapter 70*b* and the annular space 82*b* between the inner wall 81*b* and the outer wall 71*b*. The container adapter 70*b* also includes an inlet port 85*b* that is connected to the inner wall 81*b*. The inlet port 85*b* has an upper tubular section 86*b* that terminates in an upstream open end 87*b* and that terminates at an opposite end at a bottom wall 88*b*. A central hole 89*b* is provided in the bottom wall 88*b* and leads to a lower tubular section 90*b* of the inlet port 85*b*. The lower tubular section 90*b* terminates in a downstream open end 91*b* of the inlet port 85*b* which receives the dip tube 25 in a friction fit. The container adapter 70*b* can be made of a plastic material such as polyethylene or polypropylene.

A cap 95*b* is provided for securing the sprayer base 30 of the sprayer to the container adapter 70*b* as shown in FIG. 11. The cap 95*b* has an annular top wall 96*b* and a cylindrical skirt 97*b* that depends downward from the top wall 96*b*. The inner surface of the skirt 97*b* has threads 98*b* that engage the threads 79*b* on the outer surface of the skirt 77*b* of the container adapter 70*b* when the sprayer is assembled to the container 12*b*. The inner edge of the annular top wall 96*b* of the cap 95*b* is secured for rotating movement in the annular recess 37 of the outer wall 36 of the sprayer base 30.

Assembly of a sprayer to the container 12*b* proceeds as follows. A sprayer is selected with a sprayer base such as the sprayer base 30 and a cap such as cap 95*b* mounted on the sprayer base 30. The venting valve assembly 41 is constructed as in the embodiment of FIGS. 1-5. The disc-like sprayer gasket 46 is then placed on the lower surface 38 of the sprayer base 30. The exit port 60*a* of the sprayer connector 50*a* is then inserted into the downstream tubular end 32 of the sprayer base 30 as shown in FIG. 11. The sprayer connector 50*a* and the sprayer base 30 may be separate parts as shown in FIGS. 10 and 11 or alternatively, the sprayer connector 50*a* and the sprayer base 30 may be integrally formed as a single piece. In this manner, a sprayer with the sprayer connector 50*a* is provided for connection to the container 12*b*.

The container adapter 70*b* is assembled to the container 12*b*. The dip tube 25 is inserted into the downstream open end 91*b* of the inlet port 85*b* of the container adapter 70*b* in a friction fit. Alternatively, the container adapter 70*b* and the dip tube 25 may be integrally formed as a single piece, or may be secured together such as by adhesive or friction welding. The container adapter 70*b* and the dip tube 25 are then inserted into the opening 20*b* of the container 12*b* so that the outer surface 73*b* of the outer wall 71*b* of the container adapter 70*b* engages the inner surface 18*b* of the neck 17*b* of the container 12*b* and so that the circumferential rib 78*b* of the skirt 77*b* of the container adapter 70*b* enters the groove 23*b* at the top of the container 12*b* as shown in FIG. 11. The annular flange 76*b* engages the top surface 19*b* of the neck 17*b* of the container 12*b* as shown in FIG. 11. The annular flange 76*b* could also be attached to the neck 17*b* of the container 12*b* by alternative means such as welding or adhesives. In this manner, a container 12*b* with a container adapter 70*b* and attached dip tube 25 is provided for connection to a sprayer with the sprayer connector 50*a*.

In an example automated assembly of the sprayer with the sprayer connector 50*a* to the container 12*b* with the container adapter 70*b* and attached dip tube 25, a plurality of the containers 12*b* with the container adapter 70*b* and attached dip tube 25 travel on a conveyor. A sprayer with the sprayer connector 50*a* is then lowered over each container 12*b* with the container adapter 70*b* and attached dip tube 25. The outer wall 51*a* of the sprayer connector 50*a* is aligned with the upper tubular section 86*b* of the inlet port 85*b* of the container adapter 70*b*. The sprayer connector 50*a* is then lowered into the container adapter 70*b* such that the rib 56*a* on the outer wall 51*a* of the sprayer connector 50*a* seals with the inner surface of the upper tubular section 86*b* of the inlet port 85*b* of the container adapter 70*b*. The cap 95*b* is then automatically threaded on the threads 79*b* on the outer surface of the skirt 77*b* of the container adapter 70*b* to secure the sprayer to the container 12*b*.

The container adapter 70*b* is dimensioned to provide for easier automated assembly. For example. the sloping inner wall 81*b* of the container adapter 70*b* guides the outer wall 51*a* of the sprayer connector 50*a* into the upper tubular section 86*b* of the inlet port 85*b* of the container adapter 70*b*. Also, the inside diameter of the upper tubular section 86*b* of the inlet port 85*b* of the container adapter 70*b* may decrease from top to bottom to further guide the outer wall 51*a* of the sprayer connector 50*a* into the bottom region of the upper tubular section 86*b* of the inlet port 85*b* of the container adapter 70*b* wherein the rib 56*a* engages the inner surface of the upper tubular section 86*b* of the inlet port 85*b* of the container adapter 70*b*.

Referring to FIG. 11, fluid flow in the device 10*b* is as follows. Liquid in the interior space 15*b* of the container 12*b* is suctioned up through dip tube 25. The liquid then enters the lower tubular section 90*b* of the inlet port 85*b*, passes through the central hole 89*b*, and enters the bottom of the upper tubular section 86*b* of the inlet port 85*b*. The liquid then enters the fluid entry port 64*a* of the sprayer connector 50*a* and flows into the lower inner tubular section 63*a* of the sprayer connector 50*a*. Because the rib 56*a* seals against the inner surface of the upper tubular section 86*b* of the inlet port 85*b* of the container adapter 70*b*, liquid is prevented from flowing above the rib 56*a* between the inner surface of the upper tubular section 86*b* of the inlet port 85*b* of the container adapter 70*b* and the outer wall 51*a* of the sprayer connector 50*a*. From the lower inner tubular section 63*a* of the sprayer connector 50*a*, the liquid flows into the upper inner tubular section 59*a* of the sprayer connector 50*a* and exits the fluid exit port 60*a*. The liquid flows into the upstream tubular end 33 of the inlet port 31 of the sprayer base 30 and then into downstream tubular end 32 of the sprayer base 30. The liquid then enters the pumping system of the sprayer (not shown) for spraying out of the nozzle of the sprayer.

As the sprayer is actuated and liquid is removed from the interior space 15*b* of the container 12*b*, negative pressure may result in the container 12*b*. The pressure differential is eliminated by way of the venting valve assembly 41 and the venting holes 83*b* in the container adapter 70*b*. Because of the negative pressure, the duckbill valve 42 opens and air passes downward through the duckbill valve 42 into the vent passageway 43 of the sprayer base 30. The air then travels into the downstream open end 72*b* of the container adapter 70*b* and then into the annular space 82*b* between the inner wall 81*b* and the outer wall 71*b* of the container adapter 70*b* by way of the venting holes 83*b*. The air then enters the interior space 15*b* of the container 12*b* equalizing the pressure inside and outside the container 12*b*.

Because the rib 56*a* seals against the inner surface of the upper tubular section 86*b* of the inlet port 85*b* of the container adapter 70*b*, air is prevented from flowing below the rib 56*a* between the inner surface of the upper tubular section 86*b* of the inlet port 85*b* of the container adapter 70*b* and the outer wall 51*a* of the sprayer connector 50*a*. Thus, the rib 56*a* serves to establish and maintain independent liquid and air flow paths when the container adapter 70*b* and the sprayer connector 50*a* are assembled together.

The mating dimensions of the sprayer connector 50*a* and the container adapter 70*b* also provide keying structures that ensure that only refills containing a liquid appropriate for a particular purpose are used with the sprayer. Specifically, a tight fit is required between the sprayer connector 50*a* and the container adapter 70*b* so that the sprayer may be primed with liquid by way of the dip tube 25. If air leakage were to occur between the inner surface of the upper tubular section 86*b* of the inlet port 85*b* of the container adapter 70*b* and the outer wall 51*a* of the sprayer connector 50*a*, the sprayer would suck air into the sprayer rather than liquid. Therefore, only refills comprising a container 12*b* with an attached container adapter 70*b* that mates with the sprayer connector 50*a* of the sprayer would be suitable for use with the container.

Figure 12:
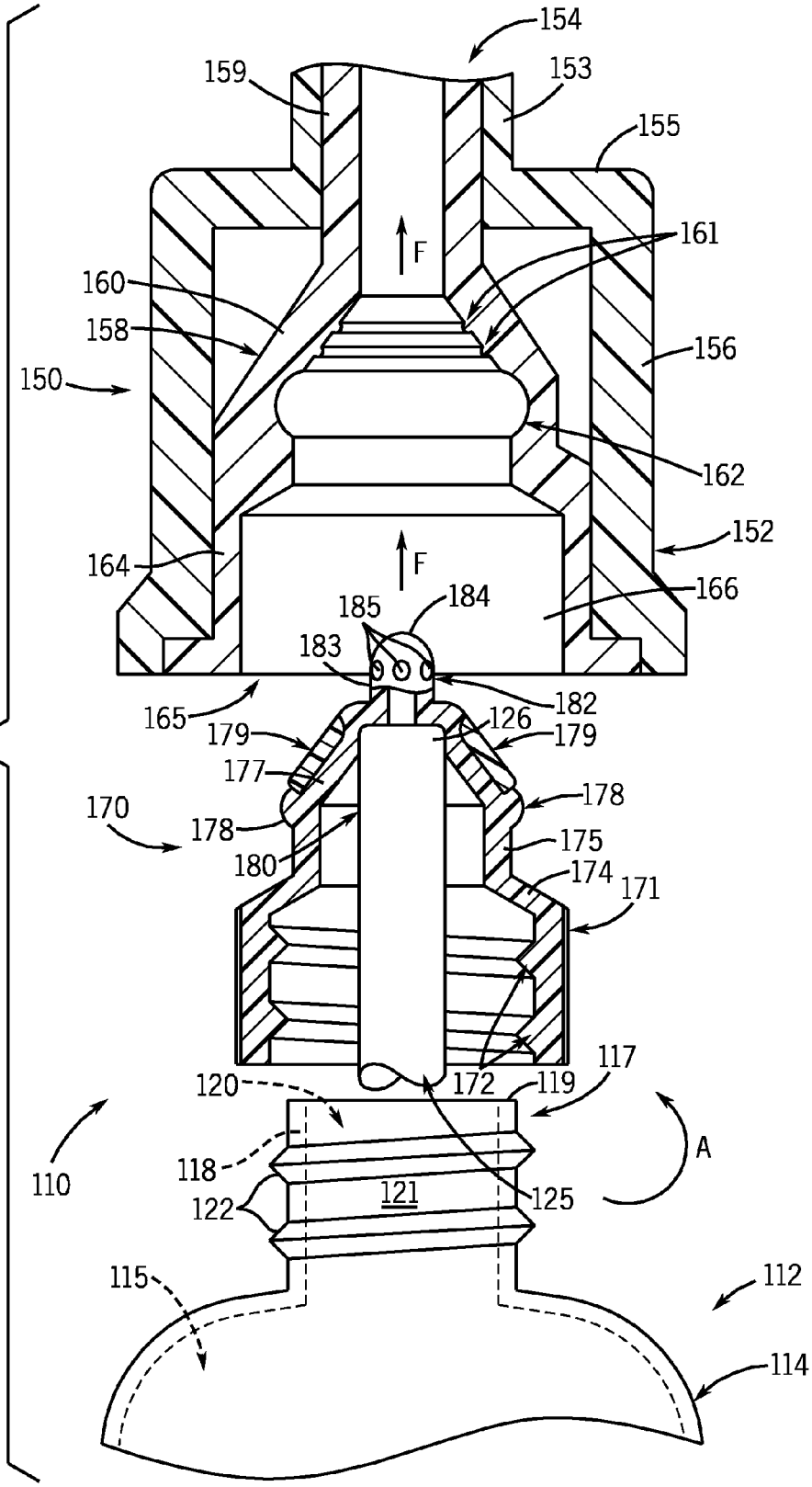
FIG. 12 is an exploded cross-sectional view of a device according to a fourth embodiment of the invention.

Turning now to FIG. 12, there is shown a fourth embodiment of a device 110 according to the invention. The device 110 is suitable for use with a sprayer with a sprayer base having an inlet port similar to that described above with reference to FIGS. 1 to 5. The device 110 may be used with a container 112 having a bottom wall that is integral with a side wall as in container 12 of FIG. 1. The bottom wall and the side wall 114 define an interior space 115 of the container 112. The side wall 114 of the container 112 terminates at its upper end in a circular neck 117 having a wall 118 and a top surface 119 that define a container opening 120. The outer surface 121 of the neck 117 of the container 112 has threads 122 for engaging a container adapter 170 as described below. A dip tube 125 is provided for suctioning fluid from the interior space 115 of the container 112. The container 112 and dip tube 125 may be formed from plastic materials.

Referring still to FIG. 12, the device 110 according to the invention includes a sprayer connector 150 that connects to the inlet port of the sprayer base. The sprayer connector 150 has a circular outer wall 152 with a downstream tubular section 153 that defines an outer wall of an exit port 154, a shoulder 155 and an upstream tubular section 156. The sprayer connector 150 also has a circular inner wall 158 including a downstream tubular section 159 that forms an inner wall of the exit port 154, a central sloping wall 160 having inner surface sealing ribs 161 and an inner surface annular recess 162, and an upstream tubular section 164 that forms an inner wall of an entry port 165. The hollow inner wall 158 defines a flow conduit 166 in the sprayer connector 150. The sprayer connector 150 may be formed from a plastic material such as ABS or like material.

Still looking at FIG. 12, the device 110 according to the invention includes a container adapter 170 that connects to the neck 117 of the container 112. The container adapter 170 includes a circular upstream tubular section 171 having inner surface threads 172, a circular upstream sloping wall 174, a circular central tubular section 175, a circular downstream sloping wall 177 having an outer sealing protrusion 178 and an outer sealing strip 179 and an inner recess 180 dimensioned to receive the dip tube 125 in a friction fit, and a fluid exit port 182. The fluid exit port 182 is a hollow circular projection 183 having a domed outer surface 184 and having circumferentially arranged flow holes 185. The container adapter 170 can be made of a plastic material such as polyethylene or polypropylene. Preferably, the outer sealing strip 179 is a softer material than the remainder of the container adapter 170. The outer sealing strip 179 may be produced in an overmolding or two shot forming process.

Assembly of a sprayer to the container 112 proceeds as follows. A sprayer is selected with a sprayer base having a tubular inlet port. The exit port 154 of the sprayer connector 150 is then inserted into the inlet port of the sprayer base. The sprayer connector 150 and the sprayer base may be separate parts or alternatively, the sprayer connector 150 and the sprayer base may be integrally formed as a single piece. In this manner, a sprayer with the sprayer connector 150 is provided for connection to the container 112.

The container adapter 170 is assembled to the container 112. The dip tube 125 is inserted into the recess 180 of the container adapter 170 in a friction fit as shown in FIG. 12. Alternatively, the container adapter 170 and the dip tube 125 may be integrally formed as a single piece, or may be secured together such as by adhesive or friction welding. The dip tube 125 are then inserted into the opening 120 of the container 112. The container adapter 170 is then lowered onto the neck 117 of the container 112 such that the inner surface threads 172 of the container adapter 170 engage the threads 122 on the outer surface 121 of the neck 117 of the container 112. Rotation of the container adapter 170 in direction A of FIG. 12 will attach the container adapter 170 to the neck 117 of the container 112. In this manner, a container 112 with a container adapter 170 and attached dip tube 125 is provided for connection to a sprayer with the sprayer connector 150.

In an example automated assembly of the sprayer with the sprayer connector 150 to the container 112 with the container adapter 170 and attached dip tube 125, a plurality of the containers 112 with the container adapter 170 and attached dip tube 125 travel on a conveyor. A sprayer with the sprayer connector 150 is then lowered over each container 112 with the container adapter 170 and attached dip tube 125. The inner wall 158 of the sprayer connector 150 is aligned with the outer surface of the container adapter 170. The sprayer connector 150 is then lowered over the container adapter 170 such that the sealing protrusion 178 on the inner surface of container adapter 170 enters the recess 162 of the sprayer connector 150. Also, the inner surface sealing ribs 161 of the sprayer connector 150 engage the outer sealing strip 179 of the container adapter 170 to provide an air-tight fit. The container adapter 170 is dimensioned to provide for easier automated assembly. For example. the sloping wall 177 of the container adapter 170 guides the sprayer connector 150 over the outer surface of the container adapter 170.

Referring still to FIG. 12, fluid flow F in the device 110 is as follows during use of the assembled device. When the sprayer is actuated (for example, by repeatedly pulling a manual trigger that operates a pump or by pulling a trigger switch that activates an electric pump), liquid in the interior space 115 of the container 112 is suctioned up through dip tube 125. The liquid then enters the hollow circular projection 183 of the fluid exit port 182 of the container adapter 170 and the liquid then exits the flow holes 185 of the fluid exit port 182. The liquid continues through the flow conduit 166 of the sprayer connector 150 and then enters the sprayer.

The mating dimensions of the sprayer connector 150 and the container adapter 170 also provide keying structures that ensure that only refills containing a liquid appropriate for a particular purpose are used with the sprayer. Specifically, a tight fit is required between the sprayer connector 150 and the container adapter 170 so that the sprayer may be primed with liquid by way of the dip tube 125. If air leakage were to occur, the sprayer would suck air into the sprayer rather than liquid. Therefore, only refills comprising a container 112 with an attached container adapter 170 that mates with the sprayer connector 150 of the sprayer would be suitable for use with the container 112.

Figure 13:
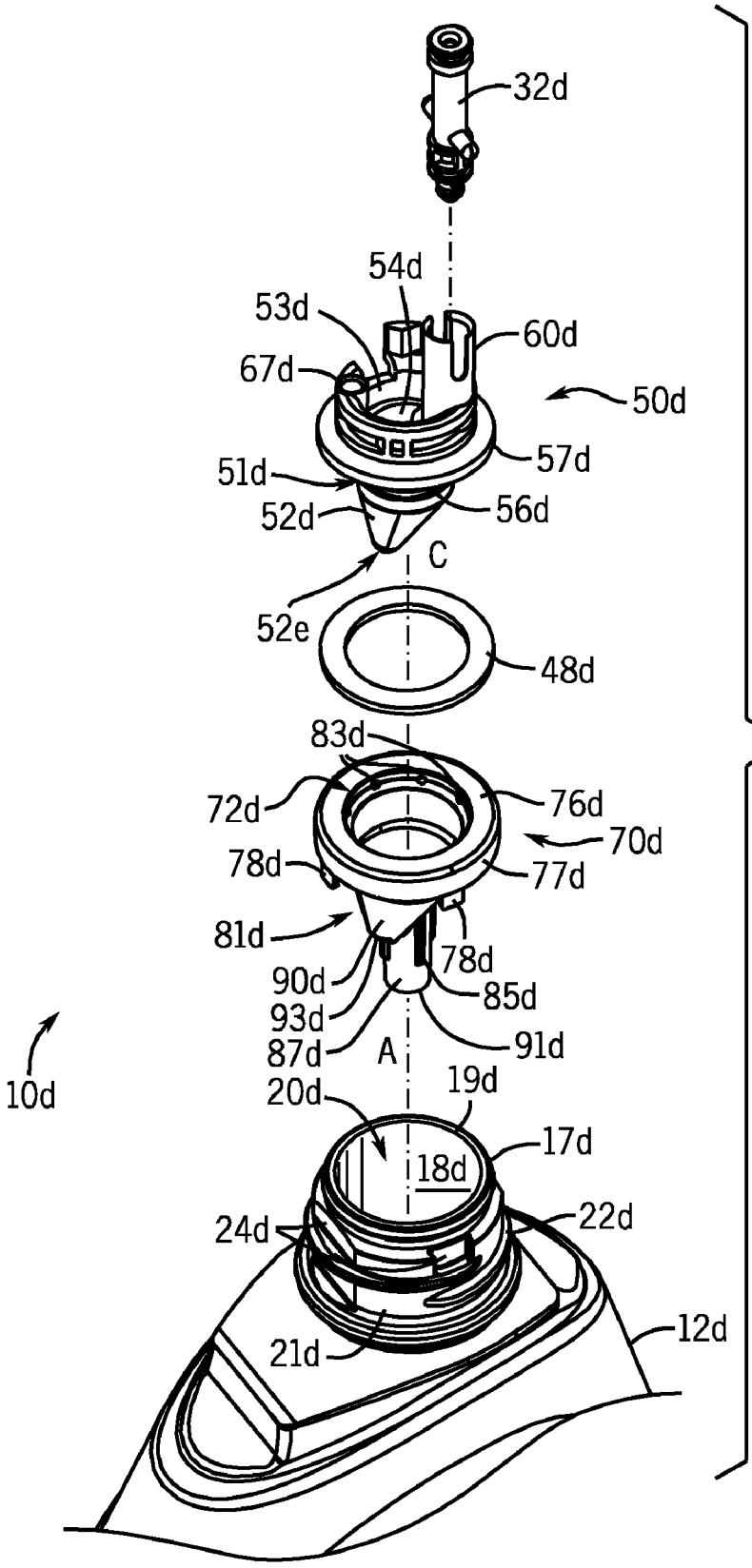
FIG. 13 is an exploded perspective view of a device according to a fifth embodiment of the invention.
Figure 14:
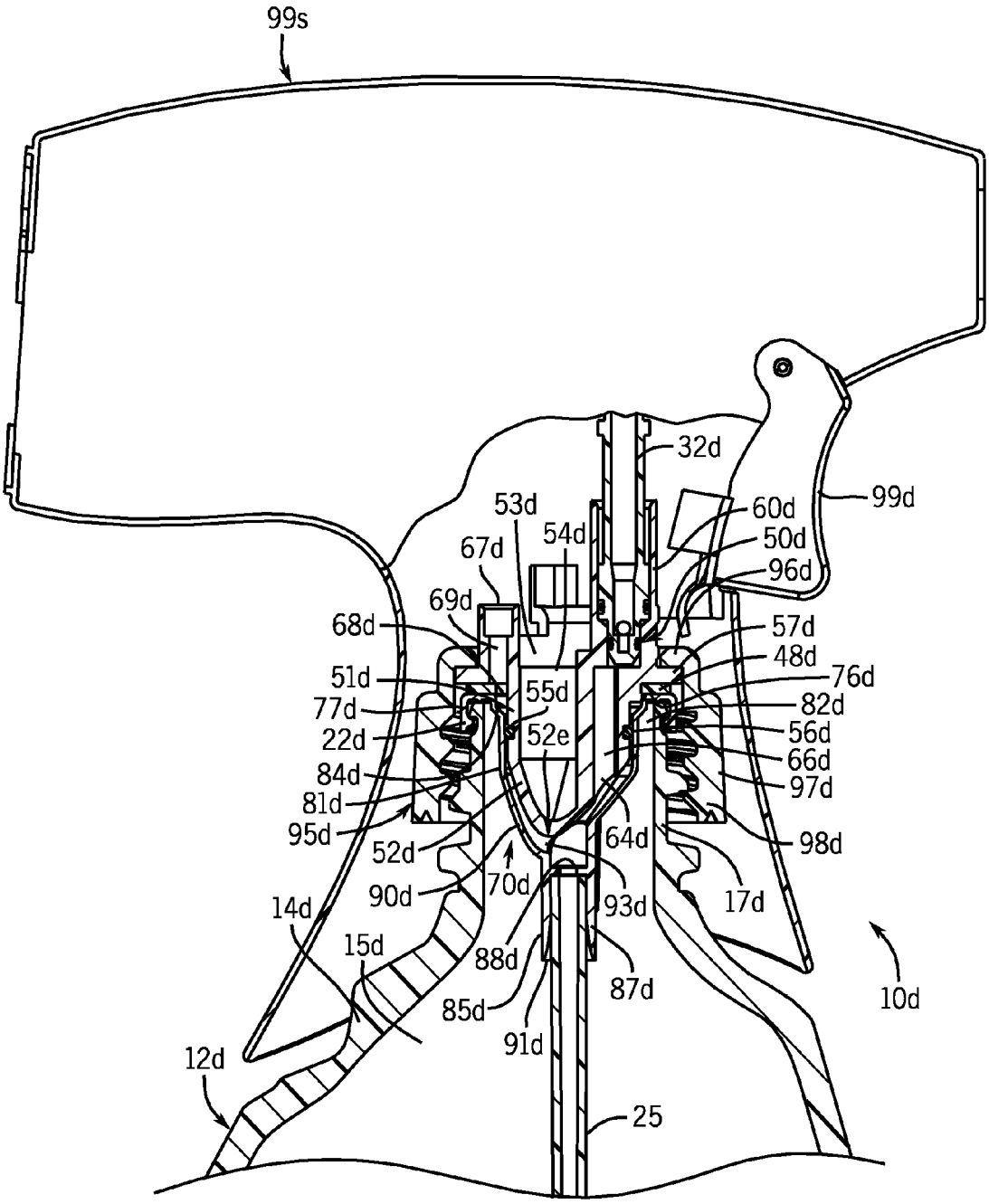
FIG. 14 is a partial cross-sectional view similar to that of FIG. 3 of the device of FIG. 13.
Figure 15:
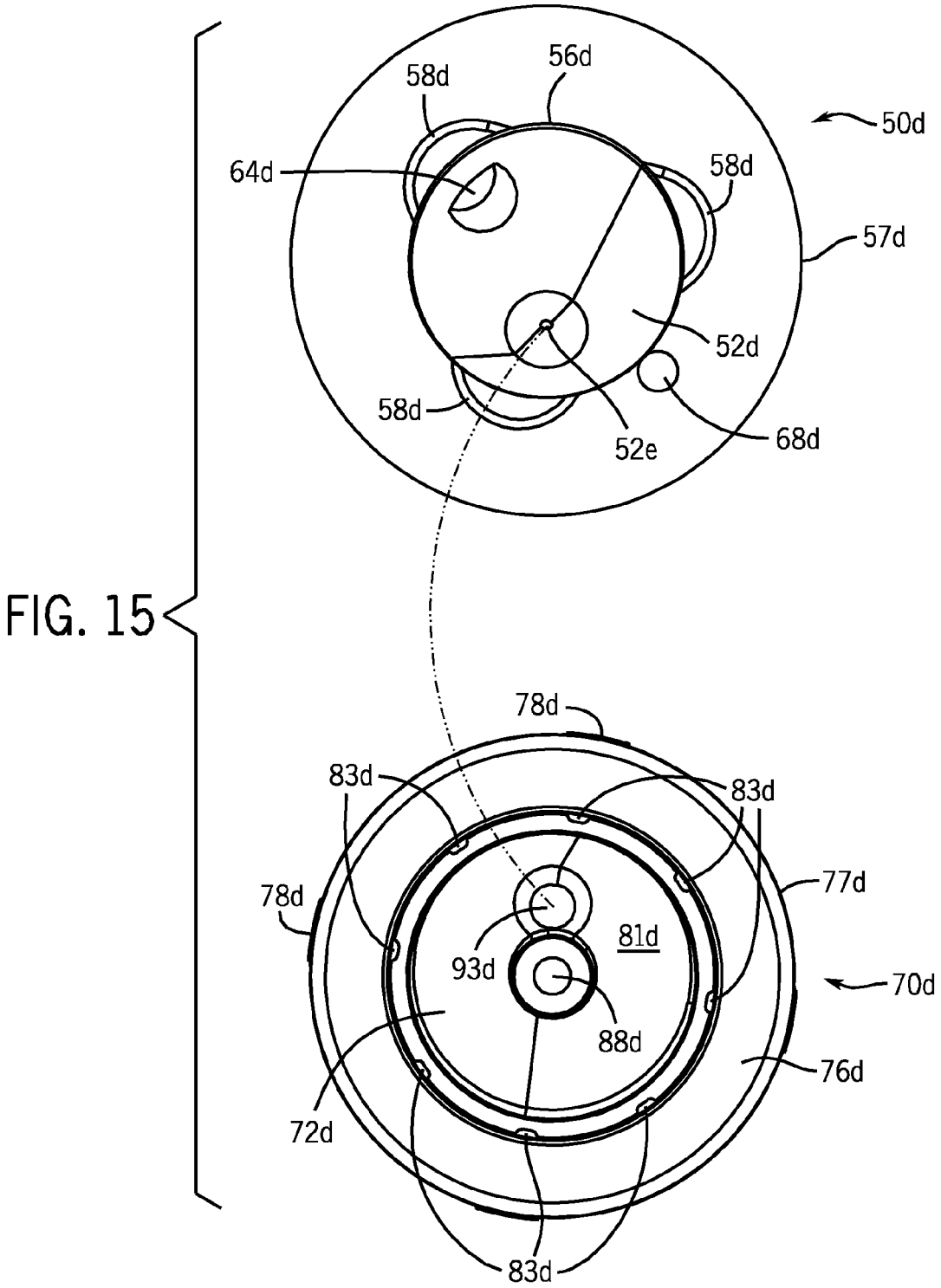
FIG. 15 shows a bottom view of the sprayer connector and a top view of the mating adapter of the device of FIG. 13.

Turning now to FIGS. 13-15, there is shown a fifth embodiment of a device 10*d* according to the invention. The device 10*d* may be used with a container 12*d* having a bottom wall that is integral with a side wall 14*d*. The bottom wall and the side wall 14*d* define an interior space 15*d* of the container 12*d*. The side wall 14*d* of the container 12*d* terminates at its upper end in a neck 17*d* having an inner surface 18*d* and a top surface 19*d* that define a container opening 20*d*. The outer surface 21*d* of the neck 17*d* of the container 12*d* has threads 22*d* and also has recesses 24*d* for engaging a container adapter 70*d* as described below. A dip tube 25 as in FIGS. 1-5 is provided for suctioning fluid from the interior space 15*d* of the container 12*d*. The container 12*d* may be formed from plastic materials.

Referring still to FIGS. 13-15, the device 10*d* according to the invention includes a sprayer connector 50*d* that connects to the inlet port 32*d* of a sprayer. The sprayer connector 50*d* may be formed from a plastic material such as ABS or polyethylene or polypropylene or like material. The sprayer connector 50*d* has a tubular outer wall 51*d* that terminates at one end in a generally funnel shaped bottom end wall 52*d* and that terminates at an opposite end in an open top end 53*d*. The outer wall 51*d* and the bottom wall 52*d* define an interior 54*d* of the sprayer connector 50*d*. The bottom wall 52*d* ends in an outwardly projecting tip 52*e* which is offset from a central longitudinal axis C of the sprayer connector 50*d*. The outer wall 51*d* of the sprayer connector 50*d* has an outer annular groove 55*d* that accepts a sealing ring which defines a sealing rib 56*d* for the sprayer connector 50*d*. An annular sealing flange 57*d* extends outward from the tubular outer wall 51*d* of the sprayer connector 50*d*. The sealing flange 57*d* has downwardly depending tabs with transverse projections 58*d* (see FIG. 15). A seal washer 48*d* abuts the bottom surface of the sealing flange 57*d*, and the seal washer 48*d* (not shown in FIG. 15) is held in place by the transverse projections of the tabs 58*d*.

The sprayer connector 50*d* includes a fluid exit port 60*d* which is offset from the central longitudinal axis C of the sprayer connector 50*d*. The bottom wall 52*d* of the sprayer connector 50*d* has a fluid entry port 64*d* that provides a fluid path to the fluid exit port 60*d* of the sprayer connector 50*d*. The fluid exit port 60*d* and the fluid entry port 64*d* define a flow conduit 66*d* in the sprayer connector 50*d*. The flow conduit 66*d* is one section of the fluid path that delivers fluid from the interior space 15*d* of the container 12*d* to the inlet port 32*d* of a sprayer.

The sprayer connector 50*d* also includes a vent entry port 67*d*. The bottom wall of the sealing flange 57*d* of the sprayer connector 50*d* has a vent hole 68*d* (see FIG. 15) that provides a vent path to the vent entry port 67*d* of the sprayer connector 50*d*. The vent entry port 67*d* and the vent hole 68*d* define an air vent conduit 69*d* in the sprayer connector 50*d*.

Still looking at FIGS. 13-15, the device 10*d* according to the invention includes a container adapter 70*d* that connects to the neck 17*d* of the container 12*d*. The container adapter 70*d* can be made of a plastic material such as ABS or polyethylene or polypropylene or the like. The container adapter 70*d* includes an outer wall that terminates at a downstream open end 72*d* of the container adapter 70*d*. The outer wall includes an annular flange 76*d* extends laterally at the downstream open end 72*d* of the container adapter 70*d*. The flange 76*d* engages the neck 17*d* of the container 12*d* as shown in FIG. 14. The outer wall also includes a skirt 77*d* that extends longitudinally downward from the outer edge of the flange 76*d*. The skirt 77*d* has at its lower end downwardly directed tabs 78*d* that engage recesses 24*d* of the container 12*d*.

The container adapter 70*d* also includes an inner wall 81*d* that is connected to the annular flange 76*d* of the outer wall. The inner wall 81*d* defines an annular space 82*d* between the inner wall 81*d* and the skirt 77*d*. Venting holes 83*d* are provided near an upper section 84*d* of the inner wall 81*d*. The container adapter 70*d* also includes an inlet port 85*d* that is connected to the inner wall 81*d*. The inlet port 85*d* has an upstream open end 87*d* that terminates in a central hole 88*d* in the bottom of a generally funnel shaped lower section 90*d* of the inner wall 81*d* of the container adapter 70*d*. A lower tubular section of the inlet port 85*d* terminates in a downstream open end 91*d* of the inlet port 85*d* which receives the dip tube 25 in a friction fit. The bottom of the lower section 90*d* of the inner wall 81*d* of the container adapter 70*d* includes a depression 93*d* adjacent the central hole 88*d* (see FIG. 15). The depression 93*d* is offset from a central longitudinal axis A of the container adapter 70*d*, while the central hole 88*d* is on the central longitudinal axis A.

A sprayer attachment cap 95*d* is provided for securing the sprayer to the neck 17*d* of the container 12*d* as shown in FIG. 14. The cap 95*d* has an annular top wall 96*d* and a cylindrical skirt 97*d* that depends downwardly from the top wall 96*d*. The inner surface of the skirt 97*d* has threads 98*d* that engage the threads 22*d* on the outer surface 21*d* of the container 12*d* when the sprayer is assembled to the container 12*d*. The inner edge of the annular top wall 96*d* of the cap 95*d* is secured for rotating movement on the sprayer base. FIG. 14 also shows a sprayer shroud 99*s* having the usual trigger 99*d*. Pumping means located within the shroud 99*s* for delivering fluid from the inlet port 32*d* of the sprayer to a nozzle (not shown) by way of actuation of the trigger 99*d* are known in the art; therefore, the pumping means (which could be manually or electrically operated) are not shown in FIG. 14 and will not be explained further.

Assembly of a sprayer to the container 12*d* proceeds as follows. The exit port 60*d* of the sprayer connector 50*d* is inserted into or over the inlet port 32*d* of the sprayer. The sprayer connector 50*d* and the inlet port 32*d* of the sprayer may be separate parts as shown in FIGS. 13 and 14 or alternatively, the sprayer connector 50*d* and inlet port 32*d* of the sprayer may be integrally formed as a single piece. In this manner, a sprayer with the sprayer connector 50*d* is provided for connection to the container 12*d*.

The container adapter 70*d* is assembled to the container 12*d*. The dip tube 25 is inserted into the downstream open end 91*d* of the inlet port 85*d* of the container adapter 70*d* in a friction fit (see FIG. 14). Alternatively, the container adapter 70*d* and the dip tube 25 may be integrally formed as a single piece, or may be secured together such as by adhesive or friction welding. The container adapter 70*d* and the dip tube 25 are then inserted into the opening 20*d* of the container 12*d* so that the annular flange 76*d* of the outer wall of the container adapter 70*d* engages the top surface 19*d* of the neck 17*d* of the container 12*d* and so that the tabs 78*d* of the skirt 77*d* of the container adapter 70*d* enter the recesses 24*d* at the top of the container 12*d* as shown in FIG. 14. The annular flange 76*d* could also be attached to the neck 17*d* of the container 12*d* by alternative means such as welding or adhesives. In this manner, a container 12*d* with a container adapter 70*d* and attached dip tube 25 is provided for connection to a sprayer with the sprayer connector 50*d*.

In an example automated assembly of the sprayer with the sprayer connector 50*d* to the container 12*d* with the container adapter 70*d* and attached dip tube 25, a plurality of the containers 12*d* with the container adapter 70*d* and attached dip tube 25 travel on a conveyor. A sprayer with the sprayer connector 50*d* is then lowered over each container 12*d* with the container adapter 70*d* and attached dip tube 25. The outer wall 51*d* of the sprayer connector 50*d* is aligned with the inner wall 81*d* of the container adapter 70*d*. The sprayer connector 50*d* is then lowered into the container adapter 70*d* such that the rib 56*d* on the outer wall 51*d* of the sprayer connector 50*d* seals with the inner surface of the inner wall 81*d* of the container adapter 70*d*. As the sprayer connector 50*d* is lowered into the container adapter 70*d*, the outwardly projecting tip 52*e* of the bottom wall 52*d* of the sprayer connector 50*d* mates with the depression 93*d* of the inner wall 81*d* of the container adapter 70*d*. (This is depicted by the curved dashed line in FIG. 15.) The cap 95*d* is then automatically threaded on the threads 22*d* on the outer surface 21*d* of the neck 17*d* of the container 12*d*.

Thus, the depression 93*d* and the inner wall 81*d* of the container adapter 70*d* provide a first alignment structure, and the outwardly projecting tip 52*e* and the bottom wall 52*d* of the sprayer connector 50*d* provide a second alignment structure whereby the sprayer connector 50*d* and the container adapter 70*d* are oriented in a specific angular relationship during assembly. The shape of the mating surface of the outwardly projecting tip 52*e* and the bottom wall 52*d* of the sprayer connector 50*d* and the shape of the corresponding mating surface of the depression 93*d* and the inner wall 81*d* of the container adapter 70*d* can vary as long as the corresponding mating surfaces match each other. The shape of the corresponding mating surfaces can vary among different products to prevent a user from placing the trigger sprayer from one product on the refill bottle of a different type of product. Also, the alignment structures of the sprayer connector 50*d* and the container adapter 70*d* provide for easier automated assembly. For example, the sloping lower section 90*d* of the inner wall 81*d* of the container adapter 70*d* guides the outer wall 51*d* of the sprayer connector 50*d* into the inner wall 81*d* of the container adapter 70*d*.

Referring to FIG. 14, fluid flow in the device 10*d* is as follows. Liquid in the interior space 15*d* of the container 12*d* is suctioned up through dip tube 25. The liquid then enters the inlet port 85*d*, passes through the central hole 88*d*, and enters the bottom of the container adapter 70*d*. The liquid then enters the fluid entry port 64*d* of the sprayer connector 50*d* and flows into the sprayer connector 50*d*. Because the rib 56*d* seals against the inner surface of the inner wall 81*d* of the container adapter 70*d*, liquid is prevented from flowing above the rib 56*d* between the inner surface of the inner wall 81*d* of the container adapter 70*d* and the outer wall 51*d* of the sprayer connector 50*d*. From the section of the sprayer connector 50*d* below the rib 56*d*, the liquid flows into the flow conduit 66*d* of the sprayer connector 50*d* and exits the fluid exit port 60*d*. The liquid then flows into the inlet port 32*d* of the sprayer, and then enters the pumping system of the sprayer (not shown) for spraying out of the nozzle of the sprayer.

As the sprayer is actuated and liquid is removed from the interior space 15*d* of the container 12*d*, negative pressure may result in the container 12*d*. The pressure differential is eliminated by way of the air vent conduit 69*d* and the venting holes 83*d* in the container adapter 70*d*. Because of the negative pressure, an umbrella valve (not shown) above the sprayer connector 50*d* opens, and air passes downward through the umbrella valve into the air vent conduit 69*d* of the sprayer connector 50*d*. The air then travels by way of the venting holes 83*d* of the container adapter 70*d* into the annular space 82*d* between the inner wall 81*d* of the container adapter 70*d* and the neck 17*d* of the container 12*d*. The air then enters the interior space 15*d* of the container 12*d* equalizing the pressure inside and outside the container 12*d*.

Because the rib 56*d* seals against the inner wall 81*d* of the container adapter 70*d*, air is prevented from flowing below the rib 56*d* between the inner surface of the inner wall 81*d* of the container adapter 70*d* and the outer wall 51*d* of the sprayer connector 50*d*. Thus, the rib 56*d* serves to establish and maintain independent liquid and air flow paths when the container adapter 70*d* and the sprayer connector 50*d* are assembled together.

The mating dimensions of the sprayer connector 50*d* and the container adapter 70*d* also provide keying structures that ensure that only refills containing a liquid appropriate for a particular purpose are used with the sprayer. Specifically, a tight fit is required between the sprayer connector 50*d* and the container adapter 70*d* so that the sprayer may be primed with liquid by way of the dip tube 25. If air leakage were to occur between the inner surface of the inner wall 81*d* of the container adapter 70*d* and the outer wall 51*d* of the sprayer connector 50*d*, the sprayer would suck air into the sprayer rather than liquid. If specific alignment structures are not present on both the sprayer connector 50*d* and the container adapter 70*d*, a tight fit will not be achieved between the sprayer connector 50*d* and the container adapter 70*d*, and air leakage will result. In the embodiment of FIGS. 13-15, the alignment structure provided by the depression 93*d* of the inner wall 81*d* of the container adapter 70*d* and the outwardly projecting tip 52*e* of the bottom wall 52*d* of the sprayer connector 50*d* provides alignment structure whereby the sprayer connector 50*d* and the container adapter 70*d* are oriented in a specific angular relationship during assembly. This ensures a tight fit and no air leakage. If one were to omit or change the location of one of the alignment structures, an airtight fit would not be achieved. It should also be appreciated that by changing the location of the depression 93*d* of the inner wall 81*d* of the container adapter 70*d* around the axis A of the container adapter 70*d* and that by changing the location of the outwardly projecting tip 52*e* of the bottom wall 52*d* of the sprayer connector 50*d* around axis C of the sprayer connector 50*d*, various mating pairs of the sprayer connector 50*d* and of the container adapter 70*d* can be provided. For example, a mating pair of the sprayer connector 50*d* and of the container adapter 70*d* for insecticide use, or for air care use, or for hard surface cleaning use can be provided. These mating pairs could be identified by color coding of the mating pair of the sprayer connector 50*d* and container adapter 70*d*. Therefore, only refills comprising a container 12*d* with an attached container adapter 70*d* that mates with the sprayer connector 50*d* of the sprayer would be suitable for a specific use of the container 12*d*.

Thus, the present invention provides a device that that places an interior space of a fluid container in fluid communication with a sprayer and that provides a keying structure such that only refill containers having a liquid appropriate for a particular purpose are used with the sprayer.

Although the present invention has been described in detail with reference to certain embodiments, one skilled in the art will appreciate that the present invention can be practiced by other than the described embodiments, which have been presented for purposes of illustration and not of limitation. Therefore, the scope of the invention should not be limited to the description of the embodiments contained herein.

INDUSTRIAL APPLICABILITY

The present invention provides a container adapter that allows a dip tube to be attached to a fluid container rather than the fluid sprayer and that provides a keying structure such that only refill containers having a liquid appropriate for a particular purpose are used with the sprayer.

What is claimed is:

1. A fluid container for attaching to a sprayer having an inlet port, the container comprising:

a bottom wall;

side wall structure;

a neck having an opening, wherein the bottom wall, the side wall structure, and the neck defines an interior space of the container; and a container adapter including (i) an outer wall that terminates at an open end of the adapter, the outer wall being dimensioned to engage the neck of the container, (ii) a hollow inlet port that terminates at an upstream open end and that terminates at a downstream open end, and (iii) a hollow inner wall connected to the outer wall and connected to the upstream open end of the inlet port, the inner wall including an alignment structure, wherein the inner wall of the adapter includes a generally funnel shaped section;

wherein the alignment structure is configured to orient the container adapter with the sprayer in a specific angular relationship, helping to ensure that only refill containers containing a liquid appropriate for use with the sprayer are used with the sprayer, and wherein the alignment structure comprises a depression in the inner wall of the adapter, the depression having a closed end.

2. The device of claim 1 wherein:

the depression in the inner wall of the adapter is offset from a central longitudinal axis of the adapter.

3. The container of claim 1 wherein:

the inlet port of the adapter further comprises a dip tube that is separable from the inlet port of the adapter, and the downstream open end of the inlet port of the adapter is dimensioned to sealingly engage the dip tube.

4. The container of claim 1 wherein:

the inner wall of the adapter includes venting holes which, during operation of the sprayer, each allow air to pass into the container to equalize a pressure throughout an inside of the container with a pressure outside the container.

5. A device for placing an inlet port of a sprayer in fluid communication with an interior space of a container including a neck having an opening, the device comprising:

a container adapter including (i) an outer wall that terminates at an open end of the adapter, the outer wall being dimensioned to engage the neck of the container, (ii) a hollow inlet port that terminates at an upstream open end and that terminates at a downstream open end, and (iii) a hollow inner wall connected to the outer wall and connected to the upstream open end of the inlet port, the inner wall including a first alignment structure, wherein the inner wall of the adapter includes a generally funnel shaped section; and a sprayer connector having a flow conduit suitable for being placed in fluid communication with the inlet port of the sprayer and the adapter, the sprayer connector being dimensioned to matingly engage the inner wall of the adapter, the sprayer connector including a second alignment structure that mates with the first alignment structure of the inner wall of the adapter when the sprayer connector engages the adapter, wherein the first alignment structure and the second alignment structure are configured to orient the sprayer connector and the container adapter in a specific angular relationship when the sprayer connector engages the container adapter, helping to ensure that only refill containers containing a liquid appropriate for use with the sprayer are used with the sprayer, and wherein the first alignment structure comprises a depression in the inner wall of the adapter, and wherein the second alignment structure comprises an outward projection on an end wall of the sprayer connector, the projection entering the depression when the sprayer connector engages the adapter, the projection having a closed end.

6. The device of claim 5 wherein:

the depression in the inner wall of the adapter is offset from a central longitudinal axis of the adapter.

7. The device of claim 5 wherein:

the device further comprises a dip tube, and the downstream open end of the inlet port of the adapter is dimensioned to sealingly engage the dip tube.

8. The device of claim 5 wherein:

the inner wall of the adapter includes venting holes which, during operation of the sprayer, each allow air to pass into the container to equalize a pressure throughout an inside of the container with a pressure outside the container.

9. The device of claim 5 wherein:

an outer surface of the sprayer connector includes at least one sealing rib for engaging the inner wall of the adapter, or an inner surface of the adapter includes at least one sealing rib for engaging the outer surface of the sprayer connector.

10. The device of claim 5 wherein:

the sprayer connector is integral with the inlet port of the sprayer.

11. The device of claim 5 wherein:

the sprayer connector includes an outwardly extending exit port in fluid communication with the flow conduit, the exit port being dimensioned to sealingly engage the inlet port of the sprayer.

12. A device for placing an inlet port of a sprayer in fluid communication with an interior space of a container including a neck having an opening, the device comprising:

a container adapter including (i) an outer wall that terminates at an open end of the adapter, the outer wall being dimensioned to engage the neck of the container, (ii) a hollow inlet port that terminates at an upstream open end and that terminates at a downstream open end, and (iii) a hollow inner wall connected to the outer wall and connected to the upstream open end of the inlet port, the inner wall including a first alignment structure; and a sprayer connector lowered into the adapter so as to have a portion positioned within the hollow inner wall, and having a flow conduit suitable for being placed in fluid communication with the inlet port of the sprayer and the adapter, the sprayer connector being dimensioned to matingly engage an inner surface of the inner wall of the adapter via a rib sealing there between, the sprayer connector including a second alignment structure that mates with the first alignment structure of the inner wall of the adapter when the sprayer connector engages the adapter;

wherein the first alignment structure and the second alignment structure are configured to orient the sprayer connector and the container adapter in a specific angular relationship when the sprayer connector engages the container adapter, helping to ensure that only refill containers containing a liquid appropriate for use with the sprayer are used with the sprayer, and wherein the first alignment structure comprises a depression in the inner wall of the adapter, and wherein the second alignment structure comprises an outward projection on an end wall of the sprayer connector, the projection entering the depression when the sprayer connector engages the adapter, the projection having a closed end.

* * * * *